US008957741B2

(12) United States Patent
Kroening

(10) Patent No.: US 8,957,741 B2
(45) Date of Patent: Feb. 17, 2015

(54) COMBINED-BRANCHED-FERRITE ELEMENT WITH INTERCONNECTED RESONANT SECTIONS FOR USE IN A MULTI-JUNCTION WAVEGUIDE CIRCULATOR

(71) Applicant: Honeywell International Inc., Morristown, NJ (US)

(72) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 4 days.

(21) Appl. No.: 13/906,458

(22) Filed: May 31, 2013

(65) Prior Publication Data

US 2014/0354368 A1 Dec. 4, 2014

(51) Int. Cl.
*H01P 1/39* (2006.01)
*H01P 1/38* (2006.01)

(52) U.S. Cl.
CPC ... *H01P 1/38* (2013.01); *H01P 1/39* (2013.01)
USPC ..... 333/1.1; 333/24.2

(58) Field of Classification Search
CPC ..... H01P 1/32–1/39; H01P 1/383
USPC ..... 333/1.1, 24.2
See application file for complete search history.

(56) References Cited

U.S. PATENT DOCUMENTS

| | | | |
|---|---|---|---|
| 3,339,158 | A | 8/1967 | Passaro |
| 4,697,158 | A | 9/1987 | Hoover et al. |
| 5,243,354 | A | 9/1993 | Stern et al. |
| 6,822,524 | B2 | 11/2004 | Hempel et al. |
| 6,885,257 | B2 | 4/2005 | Kroening |
| 7,049,900 | B2 | 5/2006 | Kroening |
| 7,176,767 | B2 | 2/2007 | Kroening |
| 7,230,507 | B2 | 6/2007 | Kroening |
| 7,242,263 | B2 | 7/2007 | Kroening |
| 7,561,003 | B2 | 7/2009 | Kroening |
| 2005/0030117 | A1 | 2/2005 | Kroening |
| 2009/0108953 | A1 | 4/2009 | Kroening |

FOREIGN PATENT DOCUMENTS

| | | |
|---|---|---|
| WO | 2005114775 | 12/2005 |

OTHER PUBLICATIONS

Smoczyneki, "Cascade-Coupled Single Junction Circulators", "Proceedings of the Fourth Colloquium on Microwave Communication", Apr. 1970, pp. 1-8, vol. 4.

European Patent Office, "Extended European Search Report from EP Application No. 14167809.4 mailed Oct. 6, 2014", "from Foreign Counterpart of U.S. Appl. No. 13/906,458", Oct. 6, 2014, pp. 1-4, Published in: EP.

*Primary Examiner* — Stephen Jones
(74) *Attorney, Agent, or Firm* — Fogg & Powers LLC

(57) ABSTRACT

The present application relates to a combined-branched-ferrite element including at least two branched-ferrite elements, the branched-ferrite elements having three branches. At least one of the three branches in the ferrite elements is connected to a branch of another one of the ferrite elements to form at least one connected-branch. The unconnected branches are input/output (I/O) branches and include input/output (I/O) apertures in respective I/O branch planes that divide the respective I/O branches into resonator sections and return-path sections. At least one connected-aperture in the at least one connected-branch that connects two ferrite elements is in a respective connected-branch plane that separates the connected-branch so that: the resonator section of the connected-branch for a first-branched-ferrite element is a return-path section of the connected-branch for a second-branched-ferrite element; and the resonator section of the connected-branch for the second-branched-ferrite element is a return-path section of the connected-branch for the first-branched-ferrite element.

20 Claims, 20 Drawing Sheets

COMBINED-BRANCHED-FERRITE ELEMENT WITH INTERCONNECTED RESONANT SECTIONS FOR USE IN A MULTI-JUNCTION WAVEGUIDE CIRCULATOR

BACKGROUND

Waveguide circulators have a wide variety of uses in commercial, military, space, terrestrial, low power applications, and high power applications. Such waveguide circulators are important in space applications (for example, in satellites) where reliability is essential and where reducing size and weight is important. Moving parts wear down over time and have a negative impact on long term reliability. Waveguide circulators made from a ferrite material have high reliability due to their lack of moving parts. Thus, the highly reliable ferrite circulators are desirable for space applications.

SUMMARY

The present application relates to a combined-branched-ferrite element including at least two branched-ferrite elements. The branched-ferrite elements have three branches. At least one of the three branches in the at least two ferrite elements is connected to a branch of another one of the at least two ferrite elements to form at least one connected-branch. Unconnected branches are input/output (I/O) branches. The I/O branches include input/output (I/O) apertures in respective I/O branch planes that divide the respective I/O branches into resonator sections and return-path sections. The at least one connected-aperture in the at least one connected-branch that connects two ferrite elements is in a respective connected-branch plane that separates the at least one connected-branch so that: the resonator section of the at least one connected-branch for a first-branched-ferrite element is a return-path section of the at least one connected-branch for a second-branched-ferrite element; and the resonator section of the at least one connected-branch for the second-branched-ferrite element is a return-path section of the at least one connected-branch for the first-branched-ferrite element.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Figure 1:
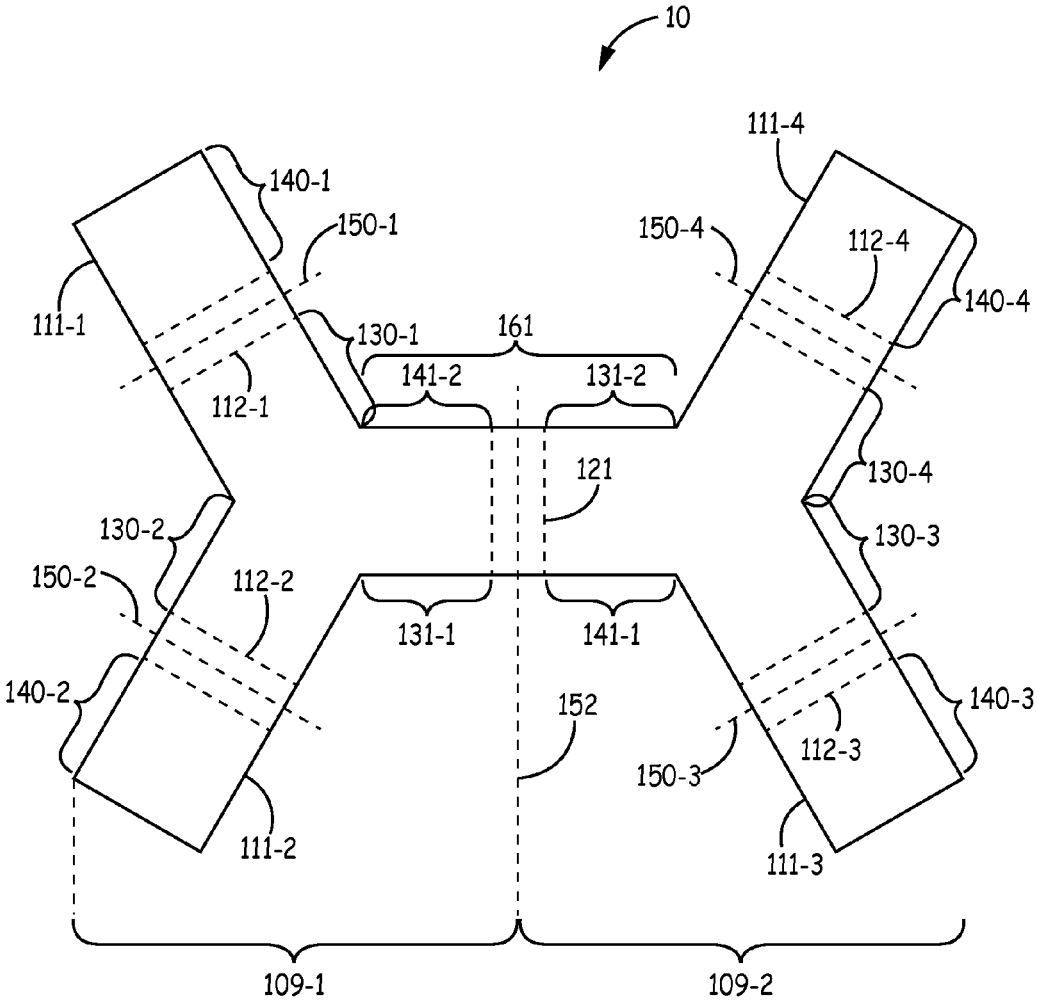
FIG. 1 illustrates a top view of a combined-branched-ferrite element in accordance with one embodiment.

FIG. 1 illustrates a top view of a combined-branched-ferrite element 10 in accordance with one embodiment. The combined-branched-ferrite element 10 includes two branched-ferrite elements 109-1 and 109-2. The first-branched-ferrite element 109-1 has three branches 111-1, 111-2, and 161. The second-branched-ferrite element 109-2 has three branches 111-3, 111-4, and 161. The first-branched-ferrite element 109-1 and the second-branched-ferrite element 109-2 are connected by the shared branch 161. The branch 161 is referred to herein as a connected-branch 161. The three branches 111-1, 111-2 and 161 extend at 120 degrees from each other and the three branches 161, 111-3 and 111-4 extend at 120 degrees from each other.

A first input/output (I/O) aperture 112-1 is in a first I/O branch 111-1 of the first-branched-ferrite element 109-1. A second I/O aperture 112-2 is in a second I/O branch 111-2 of the first-branched-ferrite element 109-1. A third I/O aperture 112-3 is in a third I/O branch 111-3 of the second-branched-ferrite element 109-2. A fourth I/O aperture 112-4 is in a fourth I/O branch 111-4 of the second-branched-ferrite element 109-2. A connected-aperture 121 is in the connected-branch 161.

The connected-aperture 121 is in a plane 152 (shown in cross-section as a dashed line labeled 152) that divides the connected-branch 161. The I/O apertures 112(1-4) are in respective I/O branch planes 150(1-4) (shown in cross-section as a dashed lines labeled 150(1-4)) that divide the respective I/O branches 111(1-4) into resonator sections 130(1-4) and return-path sections 140(1-4).

The first I/O branch 111-1 of the first-branched-ferrite element 109-1 has a first resonator section 130-1 and a first return path section 140-1. The second I/O branch 111-2 of first-branched-ferrite element 109-1 has a second resonator section 130-2 and a second return path section 140-2. The third I/O branch 111-3 of the second-branched-ferrite element 109-2 has a third resonator section 130-3 and a third return path section 140-3. The fourth I/O branch 111-4 of the second-branched-ferrite element 109-2 has a fourth resonator section 130-4 and a fourth return path section 140-4.

The resonator section 131-1 of the connected-branch 161 for the first-branched-ferrite element 109-1 is a return-path section 141-2 of the connected-branch 161 for the second-branched-ferrite element 109-2. Likewise, the resonator section 131-2 of the connected-branch 161 for the second-branched-ferrite element 109-2 is a return-path section 141-1 of the connected-branch 161 for the first-branched-ferrite element 109-1. As shown in FIG. 1, in connected-branch 161, the plane 152 separates the resonator section 131-1 from the return-path section 141-1 and separates the resonator section 131-2 from the return-path section 141-2.

The resonant section of the first-branched-ferrite element 109-1 includes the first resonator section 130-1, the second resonator section 130-2, and the resonator section 131-1 as well as the portion of the first-branched-ferrite element 109-1 in which the three branches 111-1, 111-2, and 161 converge.

The resonant section of the second-branched-ferrite element 109-2 includes the third resonator section 130-3, the fourth resonator section 130-4, and the resonator section 131-2 as well as the portion of the second-branched-ferrite element 109-2 in which the three branches 111-3, 111-4, and 161 converge.

In accordance with conventional design and theory, the dimension of the resonant section of a branched-ferrite element in a branched waveguide determines the operating frequency for circulation of an electro-magnetic field (e.g., radio frequency (RF) signals or microwave frequency signals) in the branched waveguide. It is known to those skilled in the art, that the return path sections of a ferrite element are distal (beyond the apertures in the branches) to the region in which the branches converge. The return path sections act both as return paths for the bias fields in the resonant section and as ferrite quarter-wave transformers out of the resonant section.

In one implementation of this embodiment, these I/O apertures 112(1-4) and connected-aperture 121 are formed by boring a hole through the respective I/O branches 111(1-4) and connected-branch 161 of the branched-ferrite elements 109(1-2). If a magnetizing winding is inserted through the I/O apertures 112(1-4) and connected-aperture 121, a magnetizing field can be established in the branched-ferrite elements 109(1-2). The polarity of the magnetizing field can be switched back-and-forth by the changing the direction of a current applied to the magnetizing winding in order to create a switchable circulator.

In the embodiments of the combined-branched-ferrite elements described herein, two or more branched-ferrite elements are connected by at least one connected-branch. At least one of the three branches in a ferrite element is connected to a branch of another ferrite element to form a connected-branch. The connected branch includes a connected-aperture in a connected-branch plane. The connected-branch plane separates the connected-branch so that: the resonator section of the connected-branch for a first-branched-ferrite element is a return-path section of the connected-branch for a second-branched-ferrite element; and the resonator section of the connected-branch for the second-branched-ferrite element is a return-path section of the connected-branch for the first-branched-ferrite element. This connected-branch configuration applies to one or more of the connected-branches in a combined-branched-ferrite element or in a network of combined-branched-ferrite elements. In one implementation of this embodiment, this connected-branch configuration applies to all of the connected-branches in a combined-branched-ferrite element or in a network of combined-branched-ferrite elements. Prior art branched-ferrite elements do not include connected-branches.

The combined-branched-ferrite element 10 or a network of combined-branched-ferrite elements 10 can be arranged in a branched waveguide to form a multi junction waveguide circulator as described below.

Figure 2:
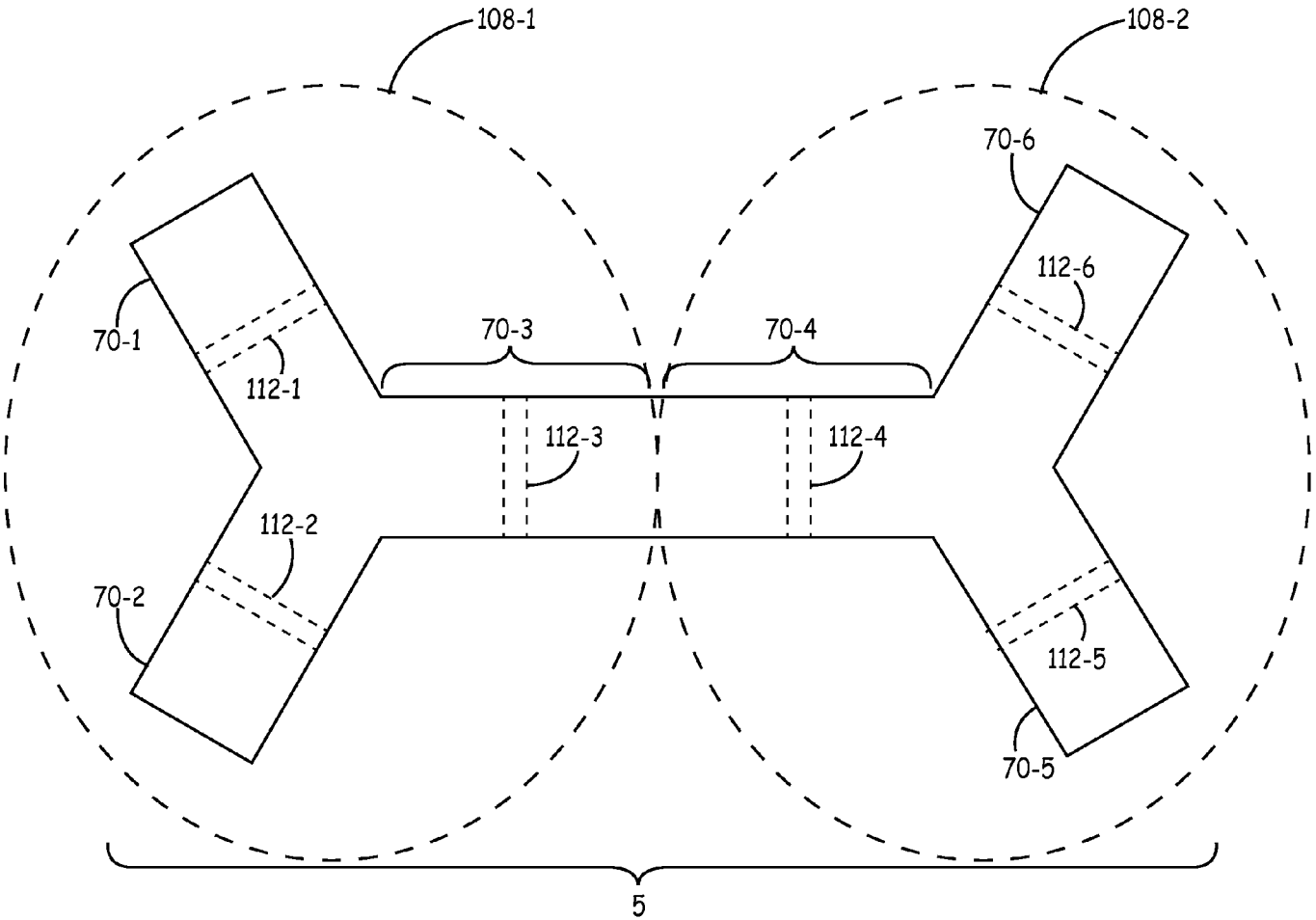
FIG. 2 PRIOR ART
FIG. 2 illustrates a top view of a currently available branched-ferrite element.

FIG. 2 illustrates a top view of a currently available branched-ferrite element 5. The prior art branched-ferrite element 5 includes a branched-ferrite element 108-1 and a branched-ferrite element 108-2. The first-branched-ferrite element 108-1 includes first branch 70-1, second branch 70-2, and third branch 70-3 that each has a respective aperture 112-1, 112-2, and 112-3. The second-branched-ferrite element 108-2 includes first branch 70-4, second branch 70-5, and third branch 70-6 that each has a respective aperture 112-4, 112-5, and 112-6. The third branch 70-3 of the first-branched-ferrite element 108-1 is adjacent to or connected to the first branch 70-4 of the second-branched-ferrite element 108-2. The adjacent or connected branches 70-3 and 70-4 include two apertures 112-3 and 112-4. The aperture 112-3 separates the resonator section of the third branch 70-3 from the return-path section of the third branch 70-3. Likewise, the aperture 112-4 separates the resonator section of the fourth branch 70-4 from the return-path section of the fourth branch 70-4. The resonator section of the third branch 70-3 is separate from the return-path section of the fourth branch 70-4. Thus, the third branch 70-3 of the first-branched-ferrite element 108-1 and first branch 70-4 of the second-branched-ferrite element 108-2, in combination, are longer than the connected-branch 161 shown in FIG. 1.

The amount of power and time required to switch a ferrite element is proportional to the volume of the ferrite element, yet only the volume of the resonant section is useful in establishing the gyromagnetic effect used to route an RF signal (or microwave frequency signal) from one branch of a branched-ferrite element in a waveguide arm to another branch of a branched-ferrite element in another waveguide arm. In fact, the return path sections of the ferrite are biased in the opposite direction of the resonant section and have minimal interaction with the RF signal as far as establishing the direction of circulation of the RF signal from one waveguide port to another. Therefore, an increase in volume of a return path section has the detrimental effect of increasing the power, ohmic loss, and time required to switch between directions of circulation.

The combined-branched-ferrite element 10 shown in FIG. 1 eliminates the ferrite element return path sections that are shown between the apertures 112-3 and 112-4 (FIG. 2) of prior art ferrite elements 108-1 and 108-2 (FIG. 2). Specifically, the combined-branched-ferrite element 10 interconnects multiple ferrite elements so that the return path of a first-branched-ferrite element is provided by the resonant section of a second-branched-ferrite element and vise-versa. The combined-branched-ferrite element 10 shown in FIG. 1 advantageously reduces the volume of the return path sections in combined-branched-ferrite element networks in order to achieve reductions in power consumption and switching time.

As shown in FIG. 1, the return path sections 140(1-4) are required on the four I/O branches of the two interconnected branched-ferrite elements 109-1 and 109-2. Each return path section 140(1-4) represents approximately ⅙ of the ferrite volume. As shown in FIG. 1, two of the return path sections in the prior art branched-ferrite element 5 of FIG. 2 have been eliminated from the two interconnected branched-ferrite elements 109-1 and 109-2, so the overall volume of the combined-branched-ferrite element 10 shown in FIG. 1 is reduced by 2/12 (16.7%) of the volume of the prior art branched-ferrite element 5. The combined-branched-ferrite element 10 shown in FIG. 1, when positioned in a branched waveguide and implemented with a control wire (described below) in a switchable multi junction waveguide circulator, has a switching time and power consumption savings of a similar order of magnitude, i.e., approximately 17%. The smaller size and decreased volume of such a switchable multi junction waveguide circulator formed from the combined-branched-ferrite element 10 also results in a lower size, mass, and ohmic loss for the multi junction waveguide circulator as compared to a switchable multi junction waveguide circulator formed from a prior art multi junction waveguide circulator 5. This advantage of combined-branched-ferrite element 10 is significant for an RF switching network formed by a plurality of combined-branched-ferrite elements 10.

As is the standard practice with traditional ferrite elements, the combined-branched-ferrite element 10 of FIG. 1 can be manufactured as a single continuous piece of ferrite, or it may be formed from ferrite sections bonded together using adhesive.

The ferrite material that forms the branched-ferrite element 109-1 and 109-2 is a non-reciprocal material. When a magnetizing field is created in the branched-ferrite element 109-1 and 109-2, a gyromagnetic effect is created. When the branched-ferrite element 109-1 and 109-2 are placed in a branched waveguide, the gyromagnetic effect provides a switching action of the RF signal from one waveguide arm to another. By reversing the direction of the magnetizing field, the direction of switching between the waveguide arms is reversed. Thus, a switching multi junction waveguide circulator is functionally equivalent to a fixed-bias multi junction waveguide circulator but has a selectable direction of circulation. RF energy can be routed with low insertion loss from one input waveguide arm of a branched waveguide housing a combined-branched-ferrite element 10 to either one of the two output waveguide arms. If one of the branches of the branched-ferrite elements 109-1 or 109-2 are in a waveguide arm that is terminated in a matched load, the multi-junction waveguide circulator acts as an isolator, with high loss in one direction of propagation and low loss in the other direction. Reversing the direction of the magnetizing field will reverse the direction of high and low isolation.

In at least one implementation, branched-ferrite elements 109-1 and 109-2 of FIG. 1 are switchable or latchable ferrite circulators as opposed to fixed bias ferrite circulators. A latchable ferrite circulator is a circulator where the direction of circulation of electromagnetic radiation can be latched in a certain direction. To make branched-ferrite elements 109-1 and 109-2 switchable, a magnetizing winding (not shown in FIG. 1) is threaded through apertures 112(1-4) and 121 in the branches 111(1-4) and 161, respectively, of branched-ferrite elements 109-1 and 109-2. Currents passed through a magnetizing winding control and establish a magnetic field in the ferrite elements 109-1 and 109-2. The polarity of magnetic field can be switched by the application of current on magnetizing winding to create a switchable circulator.

Figure 3A:
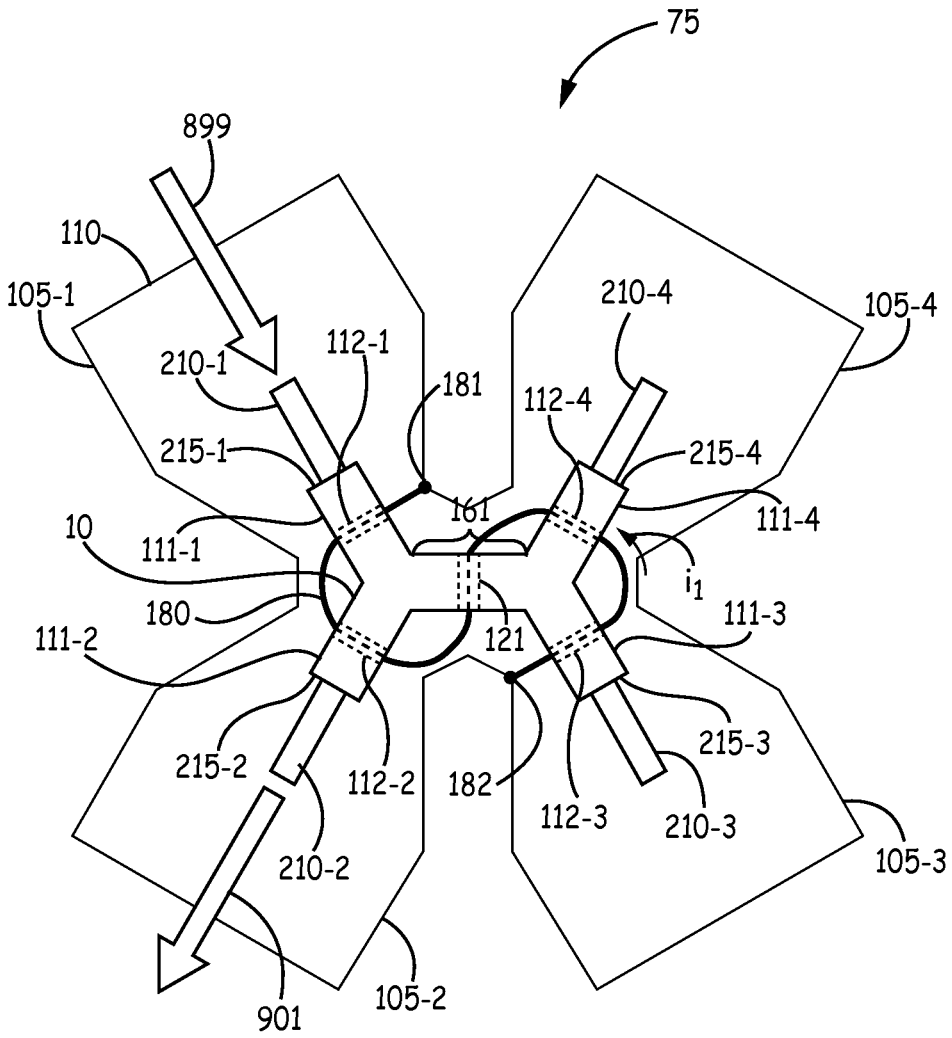
FIGS. 3A-3B illustrate top views of a multi junction waveguide circulator including the combined-branched-ferrite element of FIG. 1 in two respective switching states.
Figure 3B:
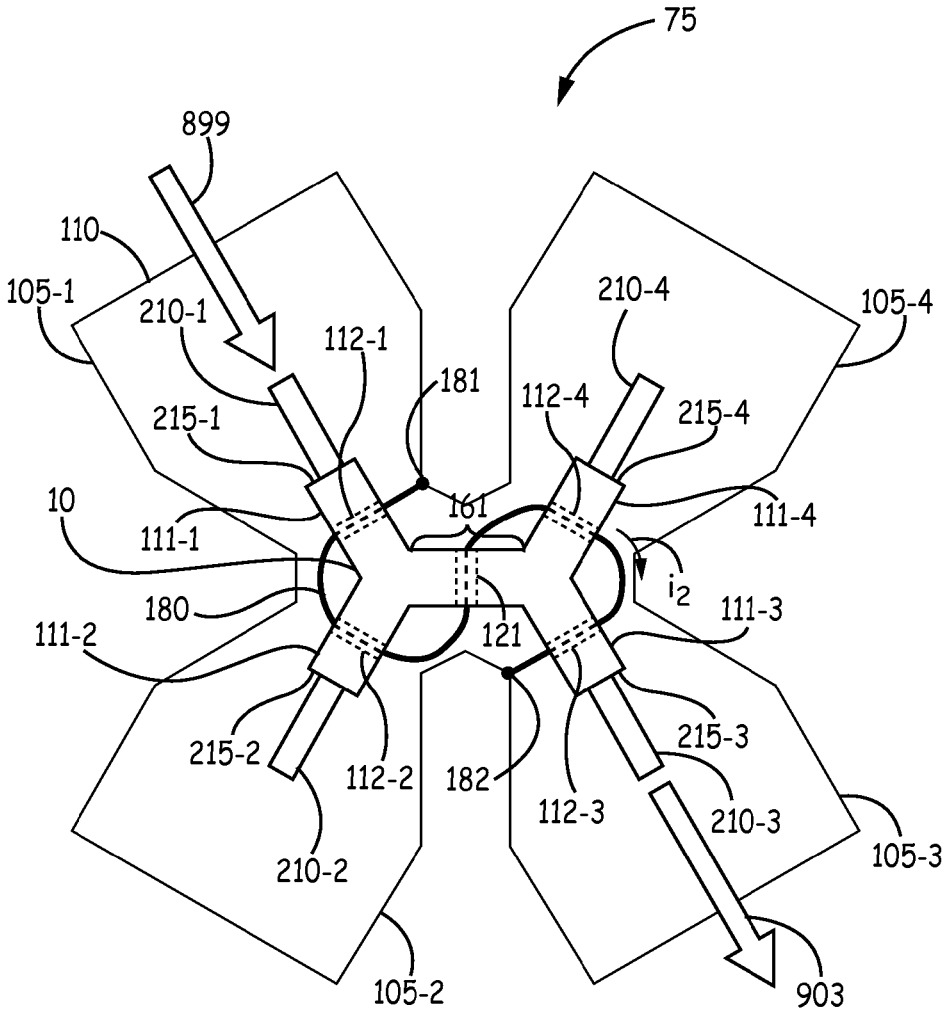

FIGS. 3A-3B illustrate top views of a multi junction waveguide circulator 75 including the combined-branched-ferrite element 10 of FIG. 1 in two respective switching states. The multi-junction waveguide circulator 75 includes a branched waveguide 110, the combined-branched-ferrite element 10, and quarter-wave dielectric transformers 210(1-4). The combined-branched-ferrite element 10 is wound with a control wire 180 (magnetizing winding 180). The branched waveguide 110 includes waveguide arms 105(1-4). The combined-branched-ferrite element 10 is arranged in the branched waveguide 110 so the I/O branches 111(1-4) of the branched-ferrite element 109-1 and 109-2 protrude into the respective waveguide arms 105(1-4). The quarter-wave dielectric transformers 210(1-4), which are optional features of the multi junction waveguide circulator 75, are attached to respective ends 215(1-4) of the I/O branches 111(1-4) of the branched-ferrite element 109-1 and 109-2. In one implementation of this embodiment, one quarter-wave dielectric transformer is attached to an end of one of the I/O branches. In another implementation of this embodiment, more than one quarter-wave dielectric transformer is attached to a respective more than one end of one I/O branch.

The control wire 180 is arranged to wind through the first I/O aperture 112-1 in the first I/O branch 111-1 of the first-branched-ferrite element 109-1, then through the second I/O aperture 112-2 in the second I/O branch of the first-branched-ferrite element 109-1, then through the connected-aperture 121 in the first connected-branch 161-1, then through the fourth I/O aperture 112-4 in the fourth I/O branch 111-4 of the second-branched-ferrite element 109-2; and then through the third I/O aperture 112-3 in the third I/O branch 111-3 of the second-branched-ferrite element 109-2. The control wire has a first-end 181 and a second-end 182. The first end 181, as shown in FIGS. 3A and 3B, is at the first I/O aperture 112-1 in the first I/O branch 111-1 of the first-branched-ferrite element 109-1. The second end 182, as shown in FIGS. 3A and 3B, is at the third I/O aperture 112-3 in the third I/O branch 111-3 of the second-branched-ferrite element 109-2.

As shown in FIG. 3A, a first switching state is achieved when a first current $i_1$ is applied to flow through the control wire 180 from the second-end 182 to the first-end 181. In the first switched state, electro-magnetic radiation (e.g., an RF signal or a microwave frequency signal) 899 that is input at the first waveguide arm 105-1, into which a first I/O branch 111-1 protrudes, is output as electro-magnetic radiation represented generally at 901 from the second waveguide arm 105-2, into which a second I/O branch 111-2 protrudes.

As shown in FIG. 3B, a second switching state is achieved, when a second current $i_2$ is applied to flow through the control wire 180 from the first-end 181 to the second-end 182. In the second switched state, electro-magnetic radiation 899 input at the first waveguide arm 105-1 is output as electro-magnetic radiation 903 from the third waveguide arm 105-3, into which a third I/O branch 111-3 protrudes.

The power consumption, switching time, size, mass, and ohmic loss of the switchable combined-branched-ferrite element 10 is less than that of the prior art branched-ferrite element 5 of FIG. 2.

Multi junction switching circulators, which are formed from one or more switchable combined-branched-ferrite elements 10 or from two or more branched-ferrite elements 109(1-N) with I/O branches 111 in a respective one or more branched waveguides 105, have a wide variety of uses in commercial and military, space and terrestrial, and low and high power applications. For example, a multi junction waveguide circulator may be implemented in a variety of applications, including but not limited to LNA redundancy switches, T/R modules, isolators for high power sources, and switch matrices. Ferrite circulators are desirable for these applications due to their high reliability, as there are no moving parts required. This is a significant advantage over mechanical switching devices. Switchable multi junction waveguide circulators, which are formed from embodiments of one or more switchable combined-branched-ferrite elements described herein, have reduced loss, size, power consumption, switching time over switchable multi junction waveguide circulators formed from prior art switchable branched-ferrite elements 5 of FIG. 2.

In one implementation of this embodiment, a switchable multi junction waveguide circulator is formed from embodiments of one or more switchable combined-branched-ferrite elements 10 that include branched-ferrite elements 109(1-N) in which at least one of the branched-ferrite elements 109(1-N) has more than two I/O branches 111. A switchable combined-branched-ferrite element is wound with a control wire 180 which is operable with two opposing directions of current flow. In another implementation of this embodiment, a switchable multi junction waveguide circulator formed from embodiments of one or more switchable combined-branched-ferrite elements that include branched-ferrite elements 109 (1-N) in which at least one of the branched-ferrite elements 109(1-N) has more than two I/O branches 111(1-M) and more than two connected-branches 161(1-P), wherein M is a positive integer greater than 2 and P is a positive integer greater than 2. In some embodiments, the branches have less than or more than 120 degrees between them.

Figure 4:
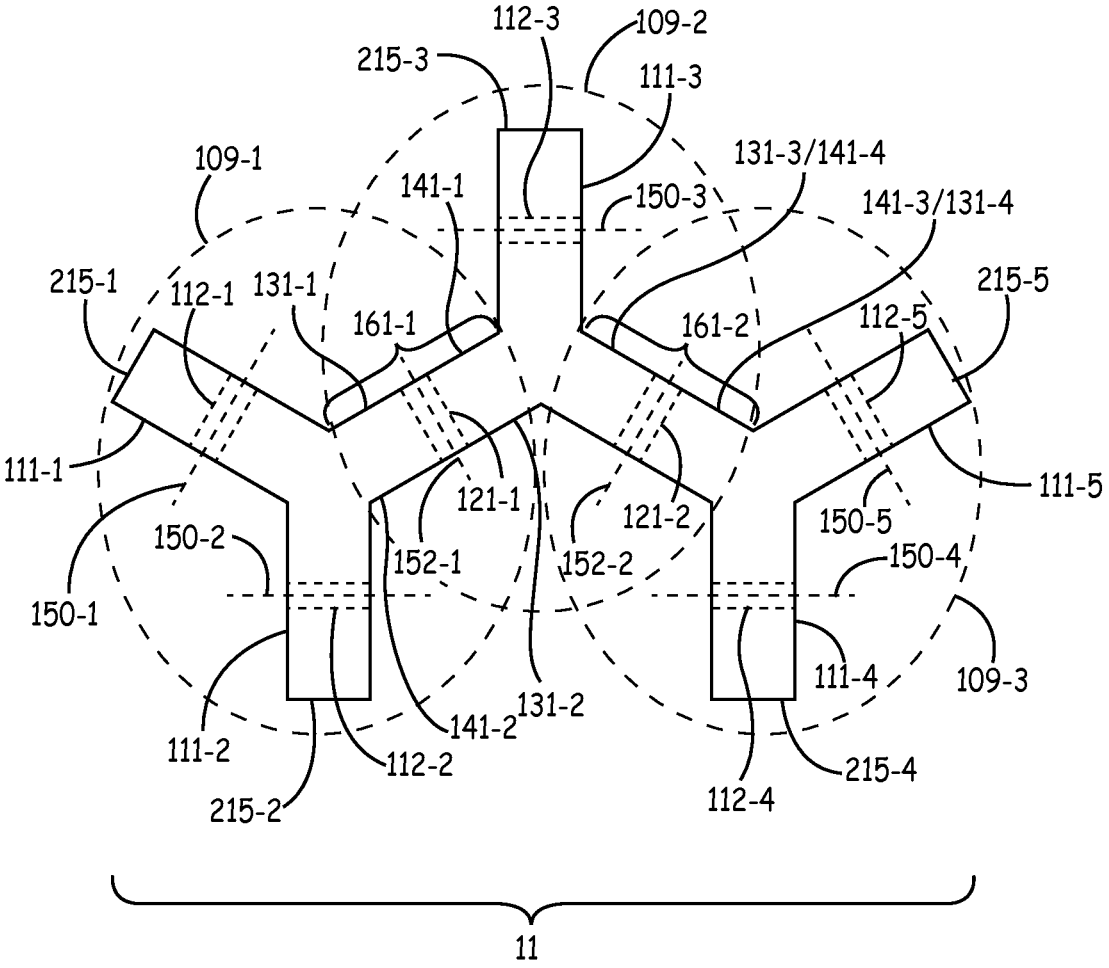
FIG. 4 illustrates a top view of a combined-branched-ferrite element in accordance with one embodiment.

FIG. 4 illustrates a top view of a combined-branched-ferrite element 11 in accordance with one embodiment. The combined-branched-ferrite element 11 includes three branched-ferrite elements 109-1, 109-2, and 109-3. The first-branched-ferrite element 109-1 has three branches 111-1, 111-2, and 161-1. The three branches 111-1, 111-2 and 161-1 extend at 120 degrees from each other. The second-branched-ferrite element 109-2 has three branches 111-3, 161-1, and 161-2. The three branches 111-3, 161-1, and 161-2 extend at 120 degrees from each other. The third-branched-ferrite element 109-3 has three branches 111-4, 111-5, and 161-2. The three branches 111-4, 111-5, and 161-2 extend at 120 degrees from each other.

The first-branched-ferrite element 109-1 and the second-branched-ferrite element 109-2 are connected by the first connected-branch 161-1. The second-branched-ferrite element 109-2 and the third-branched-ferrite element 109-3 are connected by the second connected-branch 161-2.

A first I/O aperture 112-1 is in a first I/O branch 111-1 of the first-branched-ferrite element 109-1. A second I/O aperture 112-2 is in a second I/O branch 111-2 of the first-branched-ferrite element 109-1. A third I/O aperture 112-3 is in a third I/O branch 111-3 of the second-branched-ferrite element 109-2. A fourth I/O aperture 112-4 is in a fourth I/O branch 111-4 of the third-branched-ferrite element 109-3. A fifth I/O aperture 112-5 is in a fifth I/O branch 111-5 of the third-branched-ferrite element 109-3. A first connected-aperture 121-1 is in the first connected-branch 161-1. A second connected-aperture 121-1 is in the second connected-branch 161-2. A third branch of the first-branched-ferrite element 109-1 and a first branch of the second-branched-ferrite element 109-2 are both the first connected-branch 161-1. Likewise, a third branch of the second-branched-ferrite element 109-2 and a first branch of the third-branched-ferrite element 109-3 are both the second connected-branch 161-2.

The first connected-aperture 121-1 is in a plane 152-1 (shown in cross-section as a dashed line labeled 152-1) that divides the first connected-branch 161-1. The second connected-aperture 121-2 is in a plane 152-2 (shown in cross-section as a dashed line labeled 152-2) that divides the second connected-branch 161-2. The I/O apertures 112(1-5) are in respective I/O branch planes 150(1-4) that divide the respective I/O branches 111(1-5) into resonator sections and return-path sections. For clarity of viewing the resonator sections and return-path sections for the I/O branches 111(1-5) in FIG. 4 are not labeled. However, one skilled in the art upon will understand where the resonator sections and return-path sections are located based on the above discussion with reference to FIG. 1.

The connected-branch 161-1 includes a resonator section 131-1 for the first-branched-ferrite element 109-1, which functions as the return path section 141-2 for the second-branched-ferrite element 109-2. The connected-branch 161-1 also includes a resonator section 131-2 for the second-branched-ferrite element 109-2, which functions as the return path section 141-1 for the first-branched-ferrite element 109-1. Likewise, the second connected-branch 161-2 includes a resonator section 131-3 for the second-branched-ferrite element 109-2, which functions as the return path section 141-4 for the third-branched-ferrite element 109-3, and a resonator section 131-4 for the third-branched-ferrite element 109-3, which functions as the return path section 141-3 for the second-branched-ferrite element 109-2.

Figure 5A:
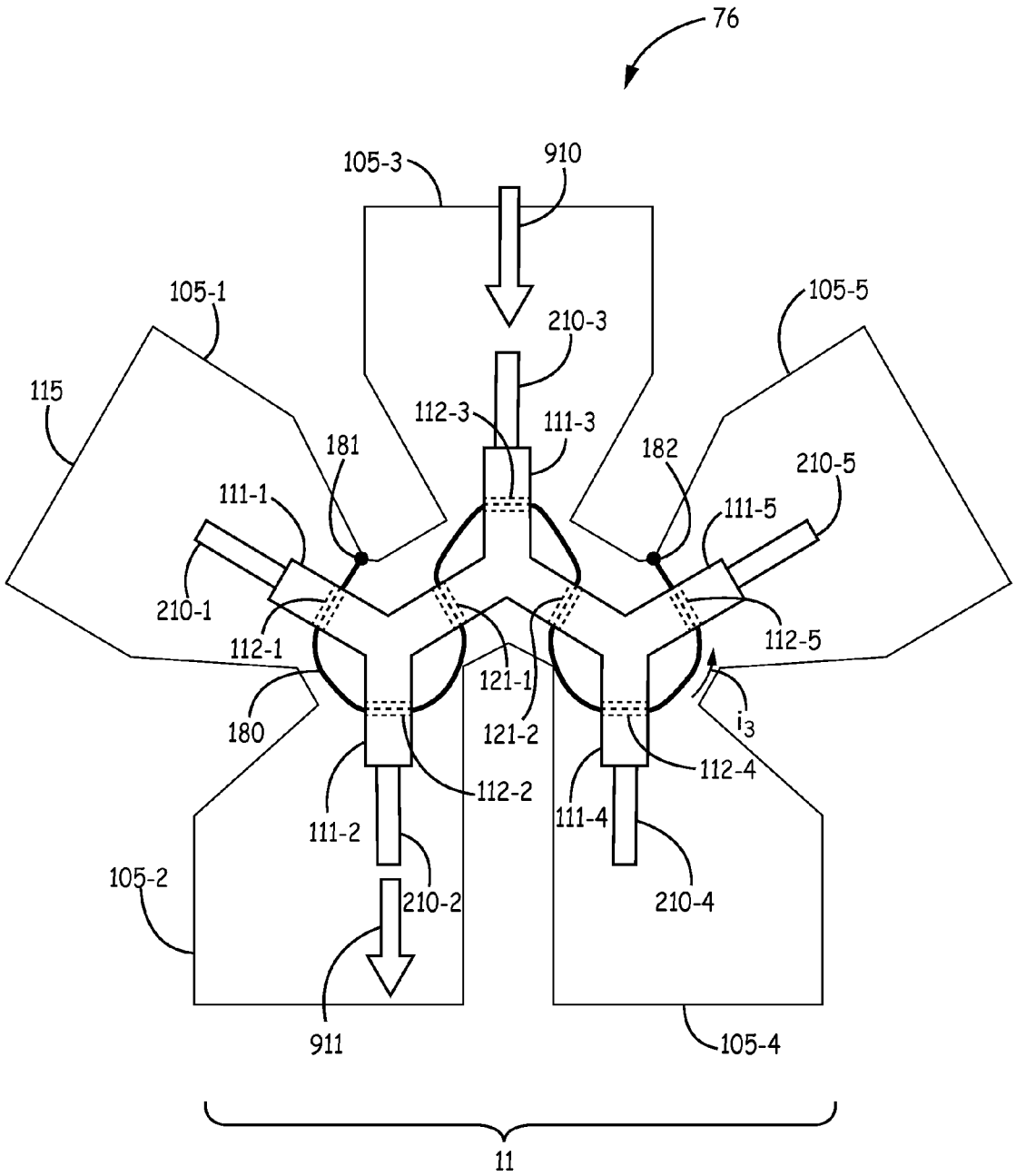
FIGS. 5A-5B illustrate top views of multi junction waveguide circulator including the combined-branched-ferrite element of FIG. 4 in two respective switching states.
Figure 5B:
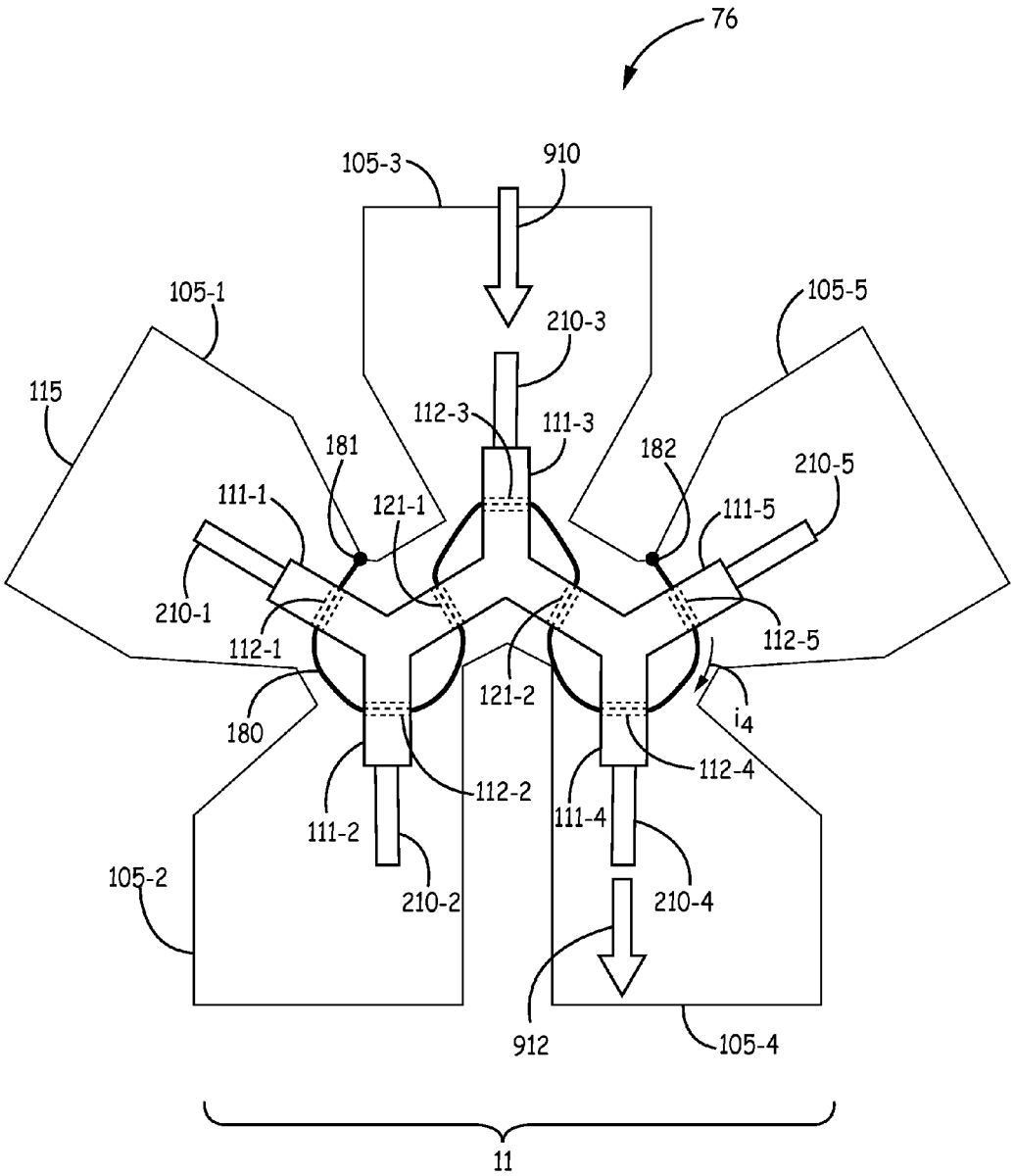

FIGS. 5A-5B illustrate top views of multi junction waveguide circulator 76 including the combined-branched-ferrite element 11 of FIG. 4 in two respective switching states. The multi-junction waveguide circulator 76 includes a branched waveguide 115, the combined-branched-ferrite element 11, and a control wire 180. The combined-branched-ferrite element 11 shown in FIGS. 5A and 5B also includes quarter-wave dielectric transformers 210(1-5). The quarter-wave dielectric transformers 210(1-5) are attached to respective ends 215(1-5) (FIG. 4) of the I/O branches 111(1-5) of the branched-ferrite element 109-1, 109-2, and 109-3. The quarter-wave dielectric transformers 210(1-5) are optional features of the multi junction waveguide circulator 76.

The branched waveguide 110 includes waveguide arms 105(1-5). The combined-branched-ferrite element 11 is arranged in the branched waveguide 115 so the I/O branches 111(1-5) of the branched-ferrite element 109-1, 109-2, and 109-3 protrude into the respective waveguide arms 105(1-5). In one implementation of this embodiment, one quarter-wave dielectric transformer is attached to an end of one I/O branch. In another implementation of this embodiment, more than one quarter-wave dielectric transformer is attached to a respective more than one end of one I/O branch.

As shown in FIGS. 5A and 5B, a control wire 180, which has a first-end 181 and a second-end 182, is arranged to wind: through a first I/O aperture 112-1 in a first I/O branch 111-1 of a first-branched-ferrite element 109-1; then through a second I/O aperture 112-2 in a second branch of the first-branched-ferrite element 109-1; then through a first connected-aperture 121-1 in the first connected-branch 161-1; then through a third I/O aperture 112-3 in a second branch 111-3 of the second-branched-ferrite element 109-2; then through a second-connected-aperture 121-2 in the second connected-branch 161-2; then through a fourth I/O aperture 112-4 in a second branch 111-4 of the third-branched-ferrite element 109-3; and then through a fifth I/O aperture 112-5 in a third I/O branch 111-5 of the third-branched-ferrite element 109-3. The first-end 181 is at the first I/O aperture 112-1 and the second-end 182 is at the fifth I/O aperture 112-5.

A first switching state of the multi junction waveguide circulator 76 is achieved, as shown in FIG. 5A, when a third current $i_3$ applied to flow from the first-end 181 to the second-end 182 causes electro-magnetic radiation 910 input at the third waveguide arm 105-3, into which the second I/O branch 111-3 of the second-branched-ferrite element 109-2 protrudes, to be output as electro-magnetic radiation 911 from the second waveguide arm 105-2, into which the second branch 111-2 of the first-branched-ferrite element 109-1 protrudes.

A second switching state of the multi junction waveguide circulator 76 is achieved, as shown in FIG. 5B, when a fourth current $i_4$ applied to flow from the second-end 182 to the first-end 181 causes the electro-magnetic radiation 910 input at the waveguide arm 105-3, into which the second branch 111-3 of the second-branched-ferrite element 109-2 protrudes, to be output as electro-magnetic radiation 912 from the fourth waveguide arm 105-4, into which the second branch 111-4 of the third-branched-ferrite element 109-3 protrudes.

When electro-magnetic radiation 910 is input at another waveguide arm (other than waveguide arm 105-3) of combined-branched-ferrite element 11 of FIG. 4, the two switching states in the multi junction waveguide circulator 76, caused by the direction of the flow of current through the control wire 180, cause electro-magnetic radiation to be output from two other separate waveguide arms into which other I/O branches protrude, as is understandable to one skilled in the art. In one embodiment, the control wire 180 in arranged to wind through the I/O apertures and the connected-apertures in a different sequential order. In this case, when the current direction is switched, electro-magnetic radiation input at one waveguide arm is output from two different waveguide arms, into which two different I/O branches protrude, as is understandable to one skilled in the art.

In one implementation of this embodiment, four branched-ferrite elements are in a combined-branched-ferrite element. Embodiments of this type, which are shown in FIGS. 6A, 6B, 7, and 8, include a first connected-branch 161-1, a second connected branch 161-2, and a third connected branch 161-3. In these embodiments, for each of the connected-branches 161(1-3), the resonator section of one connected-branch for a given ferrite element is a return-path section of the connected-branch for another connected ferrite element, while the resonator section of the connected-branch for the other connected ferrite element is a return-path section of the connected-branch for the one ferrite element.

Figure 6A:
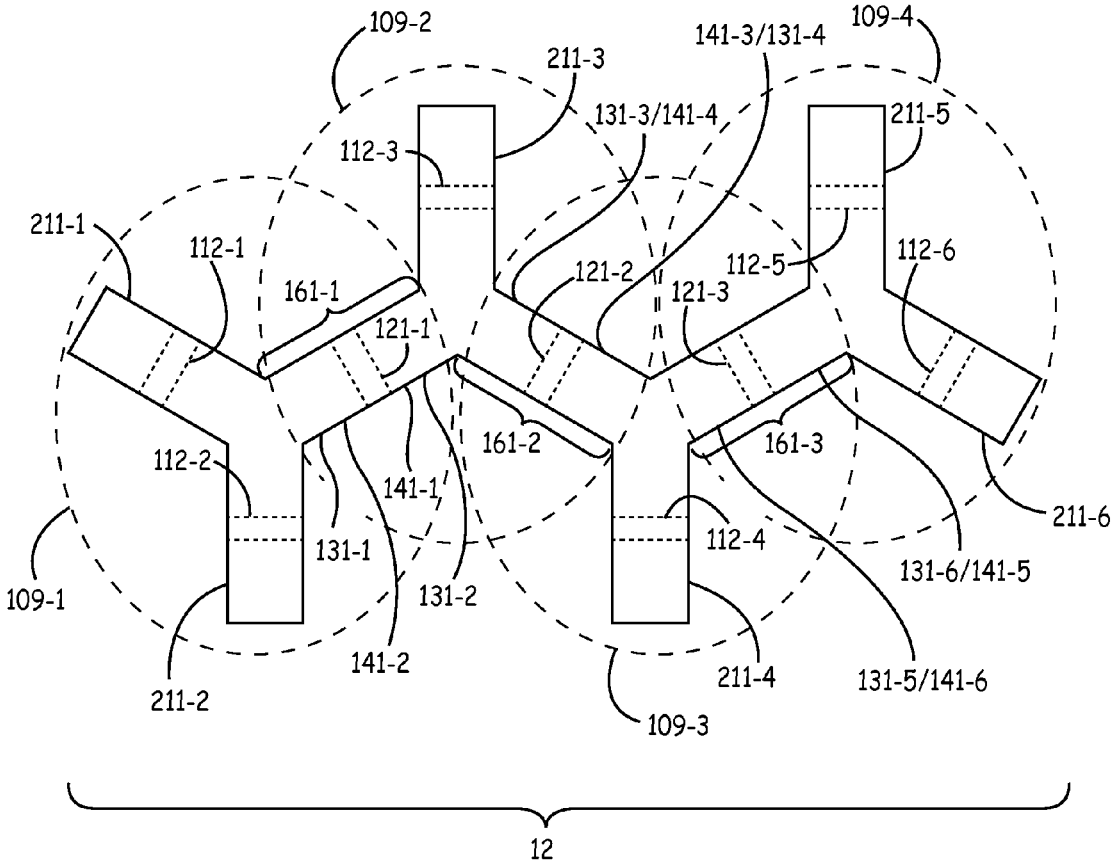
FIG. 6A illustrates a top view of a combined-branched-ferrite element in accordance with one embodiment.
Figure 6B:
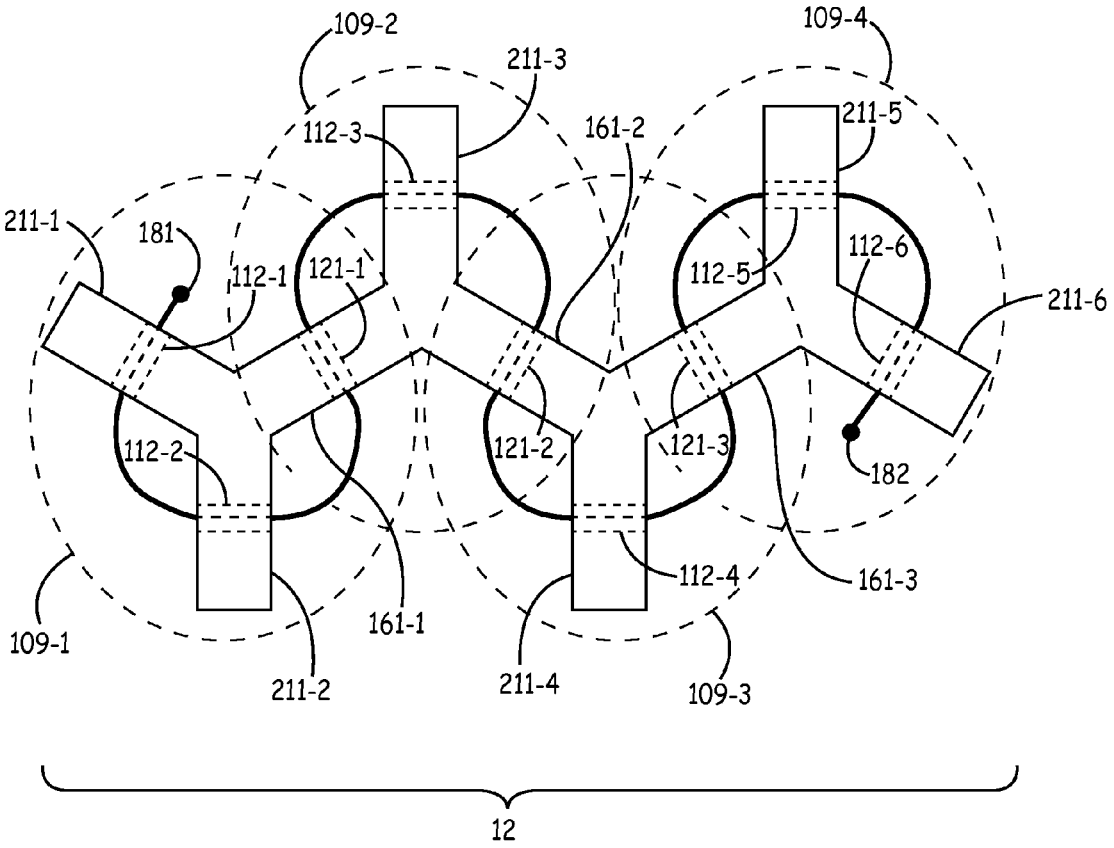
FIG. 6B illustrates a top view of the combined-branched-ferrite element of FIG. 6A wound with a control wire.

FIG. 6A illustrates a top view of a combined-branched-ferrite element 12 in accordance with one embodiment. FIG. 6B illustrates a top view of the combined-branched-ferrite element of FIG. 6A wound with a control wire 180. The first connected-branch 161-1 connects a third branch of a first-branched-ferrite element 109-1 to a first branch of a second-branched-ferrite element 109-2. The second connected branch 161-2 connects a third branch of a second-branched-ferrite element 109-2 to a first branch of a third-branched-ferrite element 109-3. The third connected branch 161-3 connects a third branch of the third-branched-ferrite element 109-3 to a first branch of a fourth-branched-ferrite element 109-4.

As shown in FIG. 6B, a control wire 180, is arranged to wind: through a first I/O aperture 112-1 in a first I/O branch 211-1 of a first-branched-ferrite element 109-1; then through a second I/O aperture 112-2 in a second I/O branch 211-2 of the first-branched-ferrite element 109-1; then through a first connected-aperture 121-1 in a first connected-branch 161-1; then through a third I/O aperture 112-3 in a second I/O branch 211-3 of the second-branched-ferrite element 109-2; then through a second-connected-aperture 121-2 in a second connected-branch 161-2; then through a fourth I/O aperture 112-4 in a second I/O branch 211-4 of the third-branched-ferrite element 109-3; then through a third-connected-aperture 121-3 in a third connected-branch 161-3; then through a fifth I/O aperture 112-5 in a third I/O branch 211-5 of the fourth-branched-ferrite element 109-4; and then through a sixth I/O aperture 112-6 in a second I/O branch 211-6 of the fourth-branched-ferrite element 109-4.

In one implementation of this embodiment, the combined-branched-ferrite element 12 is housed in a multi junction waveguide as part of a multi junction waveguide circulator. In this case, electro-magnetic radiation is input in waveguide arm, into which one of the I/O branches 211-*i* of combined-branched-ferrite element 12 of FIG. 6B protrudes (i is an integer between and inclusive of 1-6). The two switching states of such a multi junction waveguide circulator are caused by a direction of the flow of a current through the control wire 180. In a first switching state, electro-magnetic radiation is output from one of the two other separate waveguide arms into which two other I/O branches 211-*k* and 211-*l* protrude (where k and l are integers between and inclusive of 1-6 and do not equal i). In a second switching state, electro-magnetic radiation is output from the other one of two other separate waveguide arms into which the two other I/O branches 211-*k* and 211-*l* protrude, as is understandable to one skilled in the art. In another implementation of this embodiment, the control wire 180 in arranged to wind through the I/O apertures and the connected-apertures in a different sequential order. In this case, when the current direction is switched, electro-magnetic radiation input at one waveguide arm is output from two different waveguide arms as is understandable to one skilled in the art.

Figure 7:
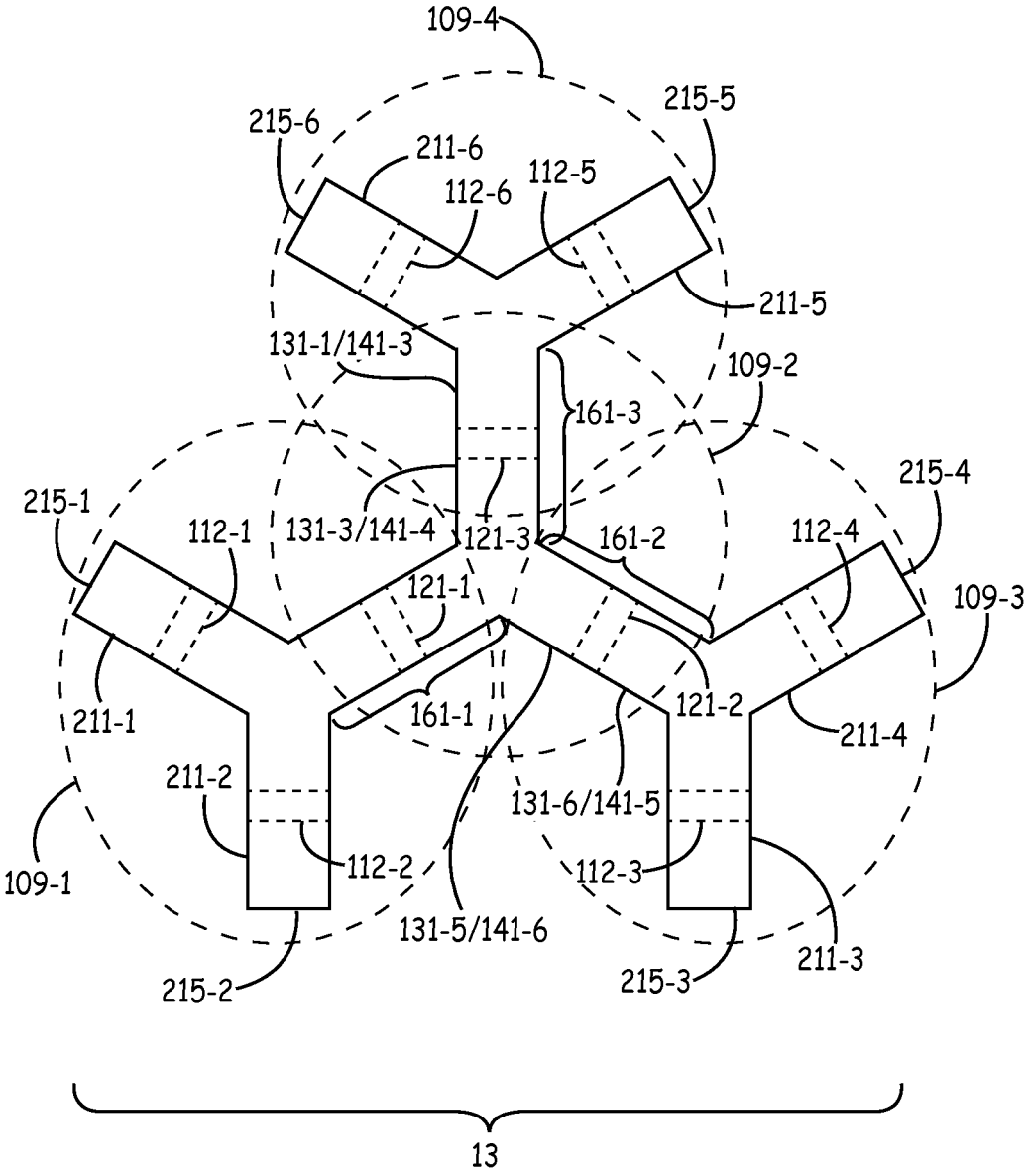
FIG. 7 illustrates a top view of a combined-branched-ferrite element in accordance with one embodiment.

FIG. 7 illustrates a top view of a combined-branched-ferrite element 13 in accordance with one embodiment. The combined-branched-ferrite element 13 includes four branched-ferrite elements 109(1-4): a first-branched-ferrite element 109-1; a second-branched-ferrite element 109-2; a third-branched-ferrite element 109-3; and a fourth-branched-ferrite element 109-4. As shown in FIG. 7, the first connected-branch 161-1 of the combined-branched-ferrite element 13 connects a third branch of the first-branched-ferrite element 109-1 to a first branch of a second-branched-ferrite element 109-2. Thus, the first connected-branch 161-1 is a third branch of the first-branched-ferrite element 109-1 and a first branch of a second-branched-ferrite element 109-2. Thus, the second connected branch 161-2 of the combined-branched-ferrite element 13 connects a second branch of the second-branched-ferrite element 109-2 to a first branch of a third-branched-ferrite element 109-3. Thus, the second connected-branch 161-2 is a second branch of the second-branched-ferrite element 109-2 and a first branch of the third-branched-ferrite element 109-3. The third connected branch 161-3 of the combined-branched-ferrite element 13 connects a third branch of the second-branched-ferrite element 109-2 to a first branch of a fourth-branched-ferrite element 109-4. Thus, the third connected-branch 161-3 a third branch of the second-branched-ferrite element 109-2 and a first branch of a fourth-branched-ferrite element 109-4.

Figure 8:
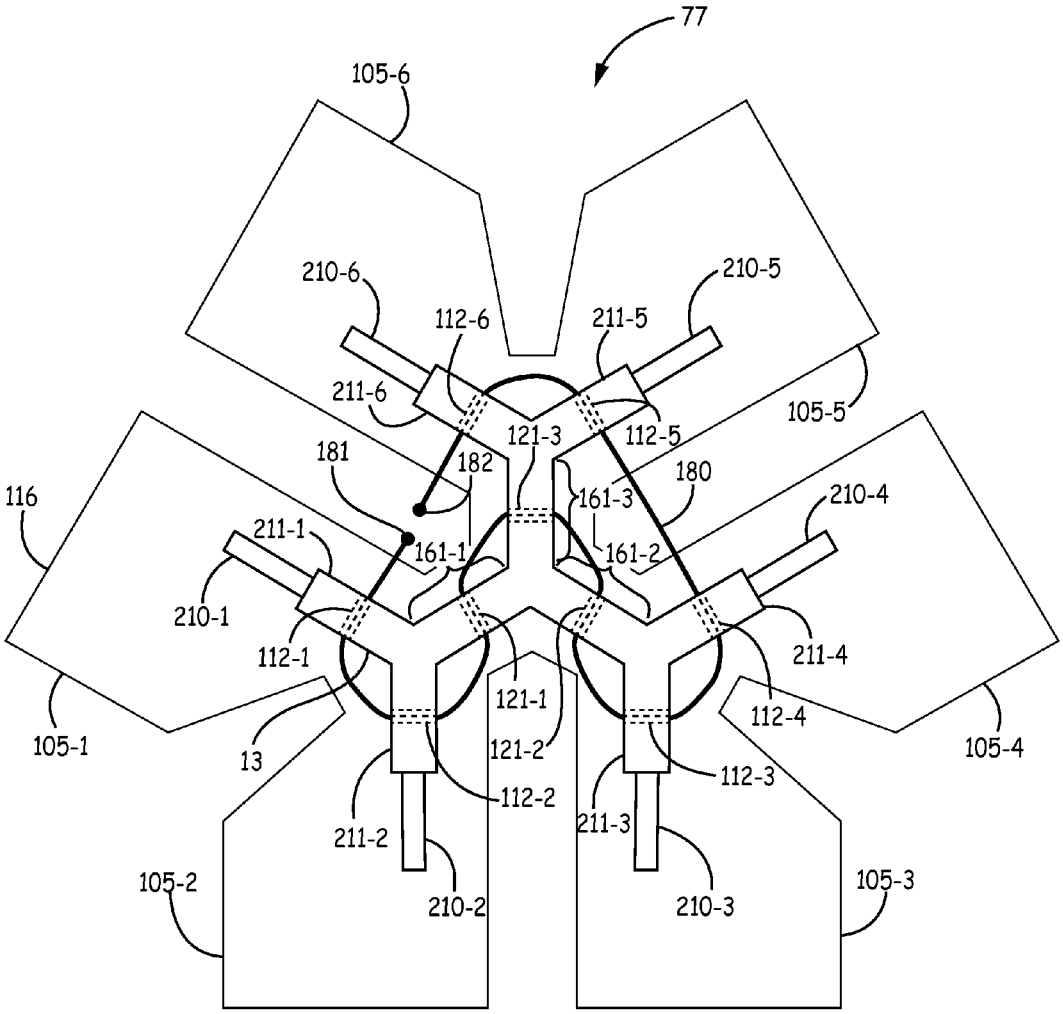
FIG. 8 illustrates a top view of a multi junction waveguide circulator including the combined-branched-ferrite element of FIG. 7.

FIG. 8 illustrates a top view of a multi junction waveguide circulator 77 including the combined-branched-ferrite element 13 of FIG. 7. The multi junction waveguide circulator 77 includes a branched waveguide 116, the combined-branched-ferrite element 13, and quarter-wave dielectric transformers 210(1-6). The combined-branched-ferrite element 13 includes a control wire 180 (magnetizing winding 180). The branched waveguide 116 includes waveguide arms 105(1-6). The combined-branched-ferrite element 13 is arranged in the branched waveguide 116 so the I/O branches 211(1-6) of the branched-ferrite elements 109-1, 109-2, 109-3, and 109-4 (FIG. 7) protrude into the respective waveguide arms 105(1-6). The quarter-wave dielectric transformers 210(1-6), which are optional features of the multi junction waveguide circulator 76, are attached to respective ends 215(1-6) of the I/O branches 211(1-6) of the branched-ferrite elements 109-1, 109-2, 109-3, and 109-4 (FIG. 7). In one implementation of this embodiment, one quarter-wave dielectric transformer is attached to an end of one of the I/O branches. In another implementation of this embodiment, more than one quarter-wave dielectric transformer is attached to a respective more than one end of one I/O branch.

A first connected-branch 161-1 connects a third branch of the first-branched-ferrite element 109-1 to a first branch of a second-branched-ferrite element 109-2. A second connected branch 161-2 connects a second branch of the second-branched-ferrite element 109-2 to a first branch of a third-branched-ferrite element 109-3. The third connected branch 161-3 connects a third branch of the second-branched-ferrite element 109-2 to a first branch of a fourth-branched-ferrite element 109-4.

As shown in FIG. 8, a control wire 180 having a first-end 181 and a second-end 182, the control wire 180 is arranged to wind: through a first I/O aperture 112-1 in the first I/O branch 211-1 of the first-branched-ferrite element 109-1; then through the second I/O aperture 112-2 in a second I/O branch 211-2 of the first-branched-ferrite element 109-1; then through the first connected-aperture 121-1 in the first connected-branch 161-1; then through the third-connected-aperture 121-3 in the third connected-branch 161-3; then through the second-connected-aperture 121-2 in the second connected-branch 161-2; then through the third I/O aperture 112-3 in the second branch 212-3 of the third-branched-ferrite element 109-3; then through the fourth I/O aperture 112-4 in the third I/O branch 211-4 of the third-branched-ferrite element 109-3; then through the fifth I/O aperture 112-5 in the second I/O branch 211-5 of the fourth-branched-ferrite element 109-4; and then through the sixth I/O aperture 112-6 in the third I/O branch 211-6 of the fourth-branched-ferrite element 109-4. In one embodiment, the control wire 180 in arranged to wind through the I/O apertures and the connected-apertures in a different sequential order. In this case, when the current direction is switched, electro-magnetic radiation input at one I/O branch is output from two different I/O branches as is understandable to one skilled in the art.

Figure 9:
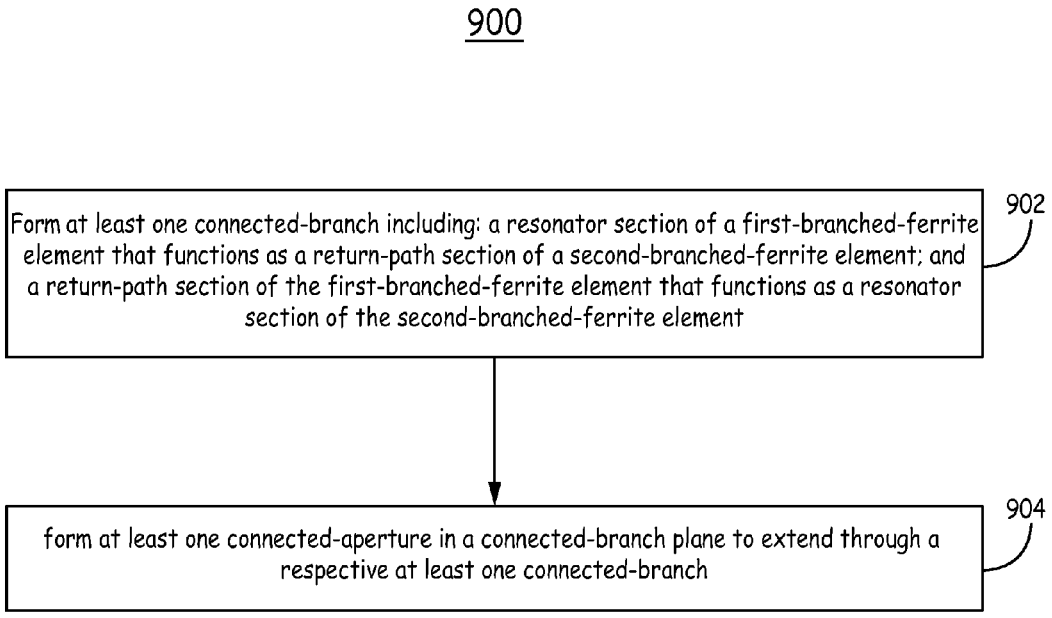
FIG. 9 is a flow diagram illustrating a method for forming a combined-branched-ferrite element in accordance with one embodiment.

FIG. 9 is a flow diagram illustrating a method 900 for forming a combined-branched-ferrite element in accordance with one embodiment. The method 900 of fabricating a combined-branched-ferrite element is described with reference to the combined-branched-ferrite element 10 of FIG. 1. Method 900 can be applied to all of the embodiments described herein.

At block 902, least one connected-branch 161 is formed. The at least one connected-branch 161 includes a resonator section 131-1 of a first-branched-ferrite element 109-1 that functions as a return-path section 141-2 of a second-branched-ferrite element 109-2. The at least one connected-branch 161 also includes a return-path section 141-1 of the first-branched-ferrite element 109-1 that functions as a resonator section 131-2 of the second-branched-ferrite element 109-2.

At block 904, at least one connected-aperture 121 is formed to extend through a respective at least one connected-branch 161-1. The at least one connected-aperture 121 is formed in a connected-branch plane 152 that separates the resonator section 131-1 of the first-branched-ferrite element 109-1 from the return-path section 141-1 of the first-branched-ferrite element 109-1.

Figure 10:
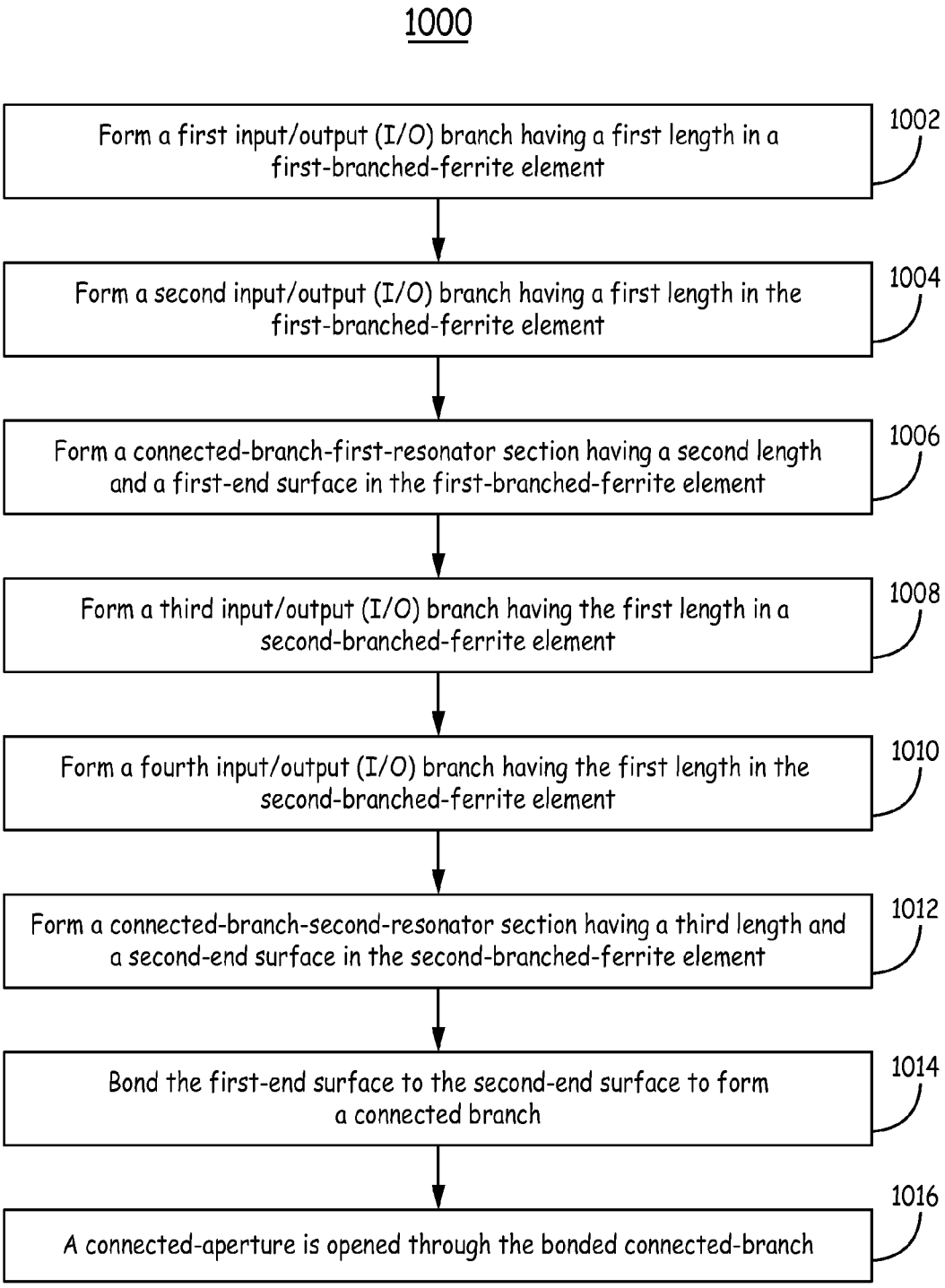
FIG. 10 is a flow diagram illustrating a method for forming a combined-branched-ferrite element in accordance with one embodiment.
Figure 11A:
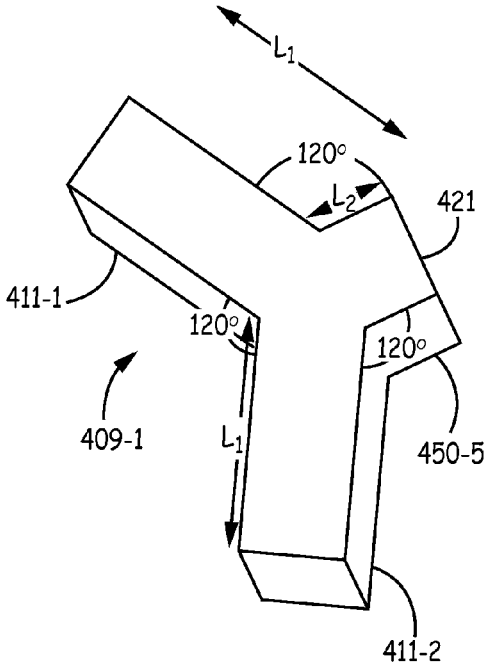
FIGS. 11A-11D illustrate oblique views of an embodiment of an implementation of the method of FIG. 10 for forming the combined-branched-ferrite element.
Figure 11B:
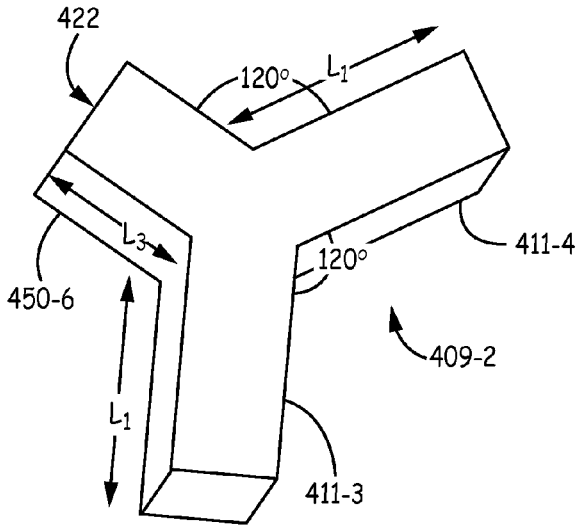
Figure 11C:
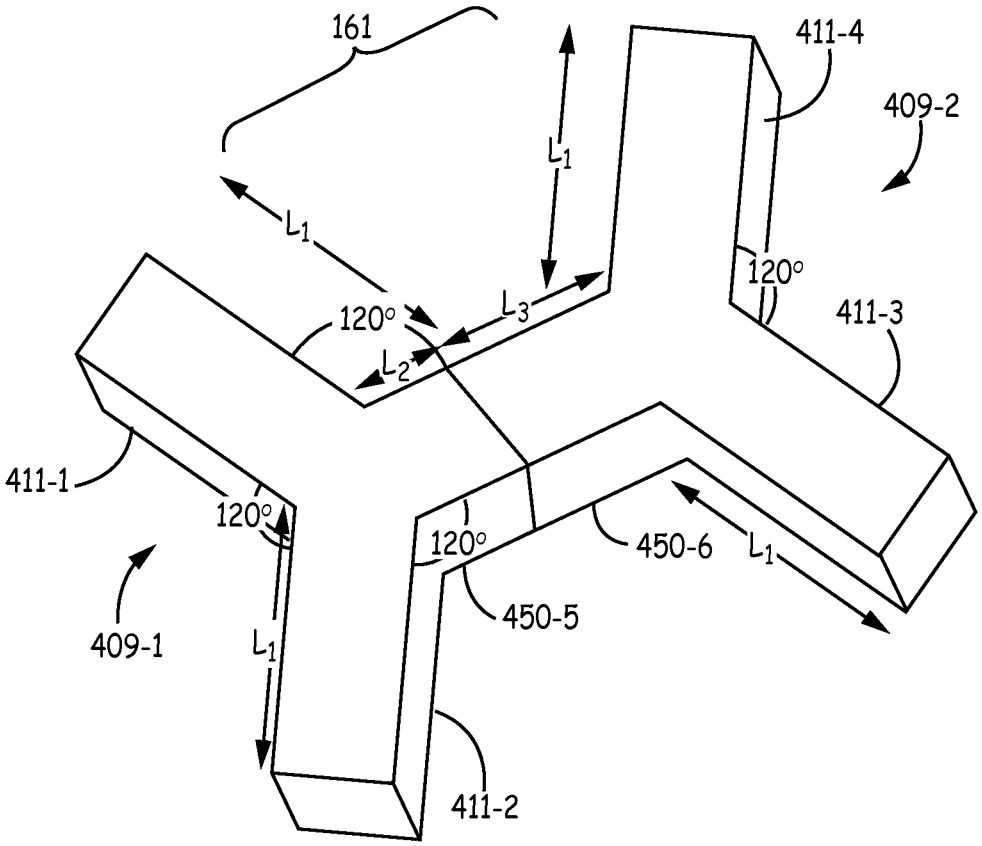
Figure 11D:
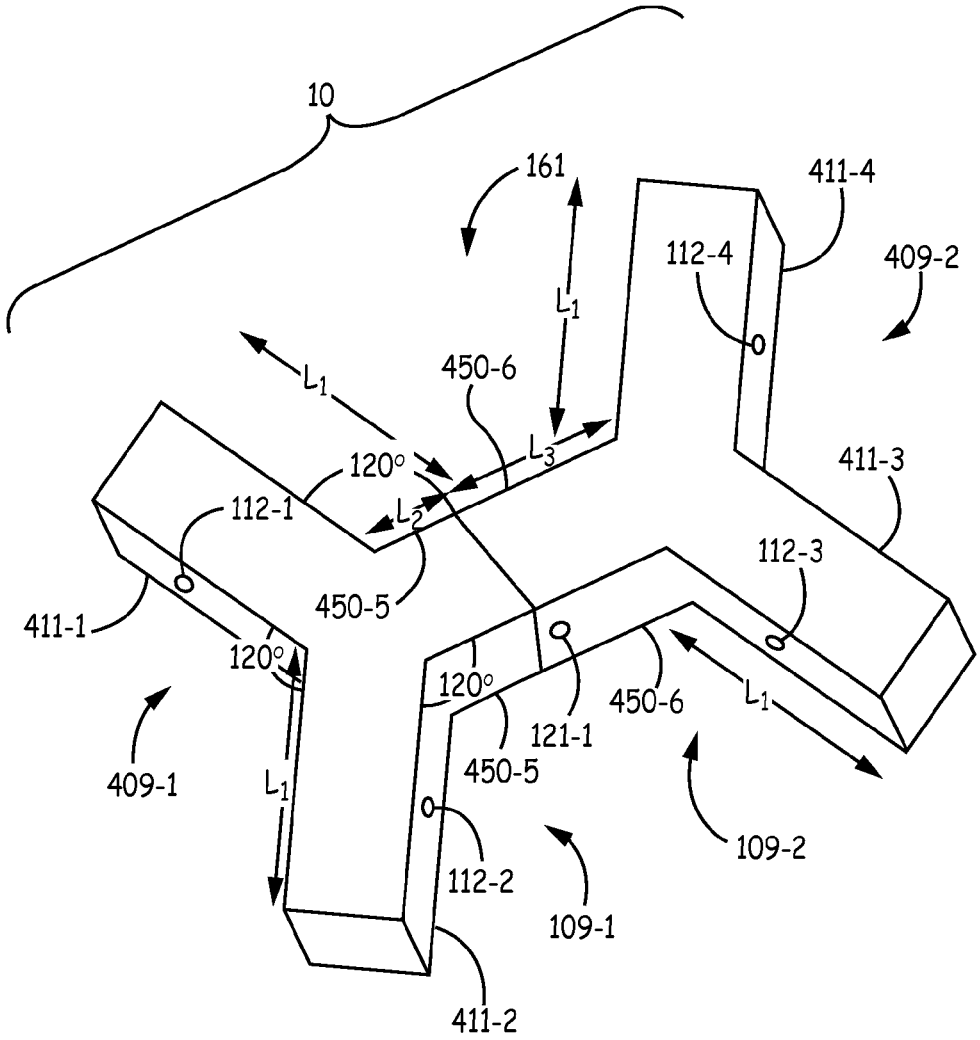

FIG. 10 is a flow diagram illustrating a method 1000 for forming a combined-branched-ferrite element in accordance with one embodiment. FIGS. 11A-11D illustrate oblique views of an embodiment of an implementation of the method of FIG. 10 for forming the combined-branched-ferrite element 10. Method 1000 is described with reference to FIGS. 11A-D and is used to form the combined-branched-ferrite element 10 of FIG. 1 as shown in FIG. 11D.

At blocks 1002-1006, the first-branched-ferrite element 409-1 (FIG. 11A), including three branches 411-1, 411-2 and 450-5 extending at 120 degrees from each other, is formed. At block 1002, a first I/O branch 441-1 having a first length $L_1$ is formed in a first-branched-ferrite element 409-1 (FIG. 11A). At block 1004, a second I/O branch having the first length is formed in the first-branched-ferrite element 409-1. At block 1006, a connected-branch-first-resonator section 450-5 having a second length $L_2$ and having a first-end surface 421 (FIG. 11A) is formed in the first-branched-ferrite element 409-1. In one implementation of this embodiment, the actions of blocks 1002-1006 are done by machining the first-branched-ferrite element 409-1 from a block of ferrite in a single machining process.

At blocks 1008-1012, the second-branched-ferrite element 409-2 (FIG. 11B), including three branches 411-3, 411-4 and 450-6 extending at 120 degrees from each other, is formed. At block 1008, a third I/O branch 411-3 having the first length $L_1$ is formed in the second-branched-ferrite element 409-2. At block 1010, a fourth I/O branch 411-4 having the first length $L_1$ is formed in the second-branched-ferrite element 409-2. At block 1012, a connected-branch-second-resonator section 450-6 having a third length $L_3$ and having a second-end surface 422 is formed. In one implementation of this embodiment, the actions of blocks 1008-1012 are done by machining the second-branched-ferrite element 409-2 from a block of ferrite in a single machining process.

At block 1014, the first-end surface 421 is bonded to the second-end surface 422 to form the connected-branch 161 of FIG. 1. This is shown in FIG. 11C. The first-branched-ferrite element 409-1 and the second-branched-ferrite element 409-2 are bonded together with extremely thin bondlines to form the structure shown in FIG. 11C. The bonded connected-branch-first-resonator section 450-5 and connected-branch-second-resonator section 450-6, when bonded, form the connected-branch 161 of FIG. 1. In one implementation of this embodiment, the adhesive is a thin layer of non-magnetic epoxy. This non-magnetic bond line acts like an air gap in a magnetic circuit, so it reduces how strongly the ferrite is magnetized by the current if the bond thickness is of significant thickness. In one implementation of this embodiment, the adhesive is a magnetic/iron loaded epoxy. Other adhesives are possible.

At block 1016, the connected-aperture 121-1 (FIG. 11D) is opened through the bonded at least one connected-branch 161. Typically, the connected-aperture 121-1 (FIG. 11D) is opened through the bonded connected-branch 161 to bisect the connected-branch 161. In one implementation of this embodiment, the connected-aperture 121-1 is drilled through the connected-branch 161. In another implementation of this embodiment, the connected-aperture 121-1 is etched through the connected-branch 161. Other techniques to open the connected-aperture 121-1 in the connected-branch 161 are possible. In one implementation of this embodiment, the second length $L_2$ and the third length $L_3$ do not equal each other. In this case, if the connected-aperture 121-1 bisects the bonded connected-branch 161 the connected-aperture 121-1 will not be made along the adhesive bonding plane. The I/O apertures 112(1-4) are also opened through the respective branches 411(1-4). In one implementation of this embodiment, the I/O apertures 112(1-4) are opened prior to bonding done at block 1014.

Figure 12:
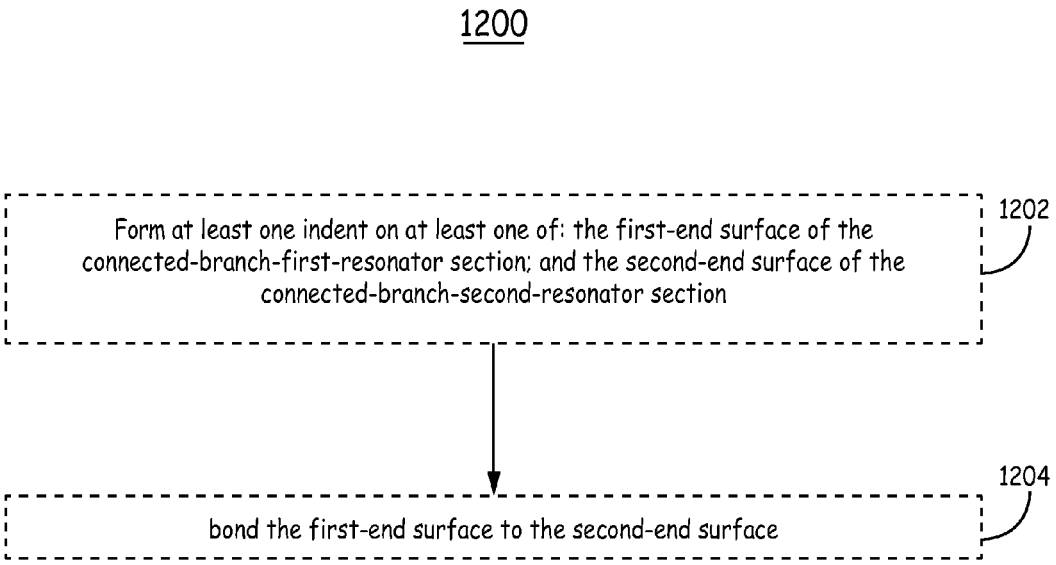
FIG. 12 is a flow diagram illustrating a method for forming a connected-aperture in a connected-branch in a combined-branched-ferrite element in accordance with one embodiment.
Figure 13A:
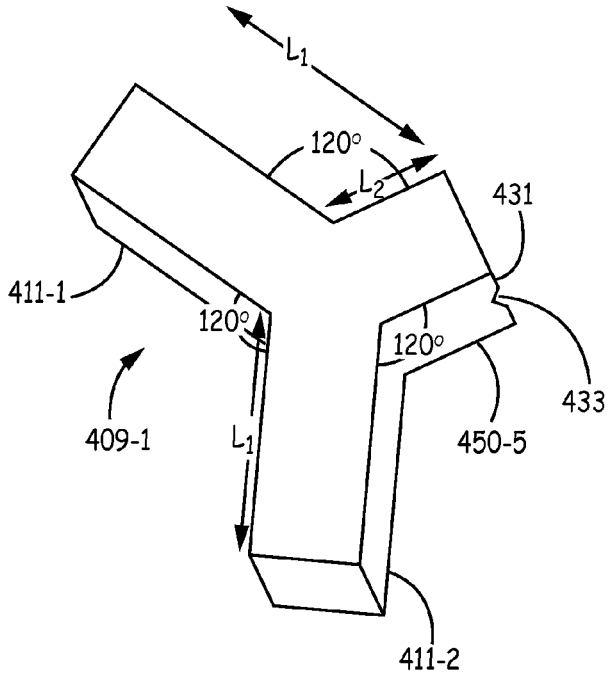
FIGS. 13A-13C illustrate oblique views of an embodiment of an implementation of the method of FIG. 12 for forming the combined-branched-ferrite element.
Figure 13B:
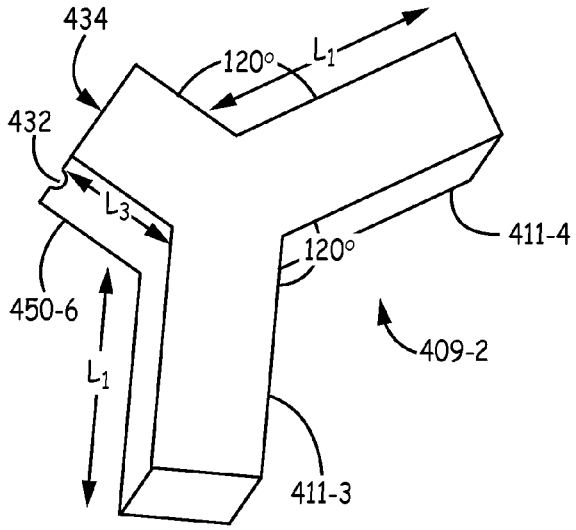
Figure 13C:
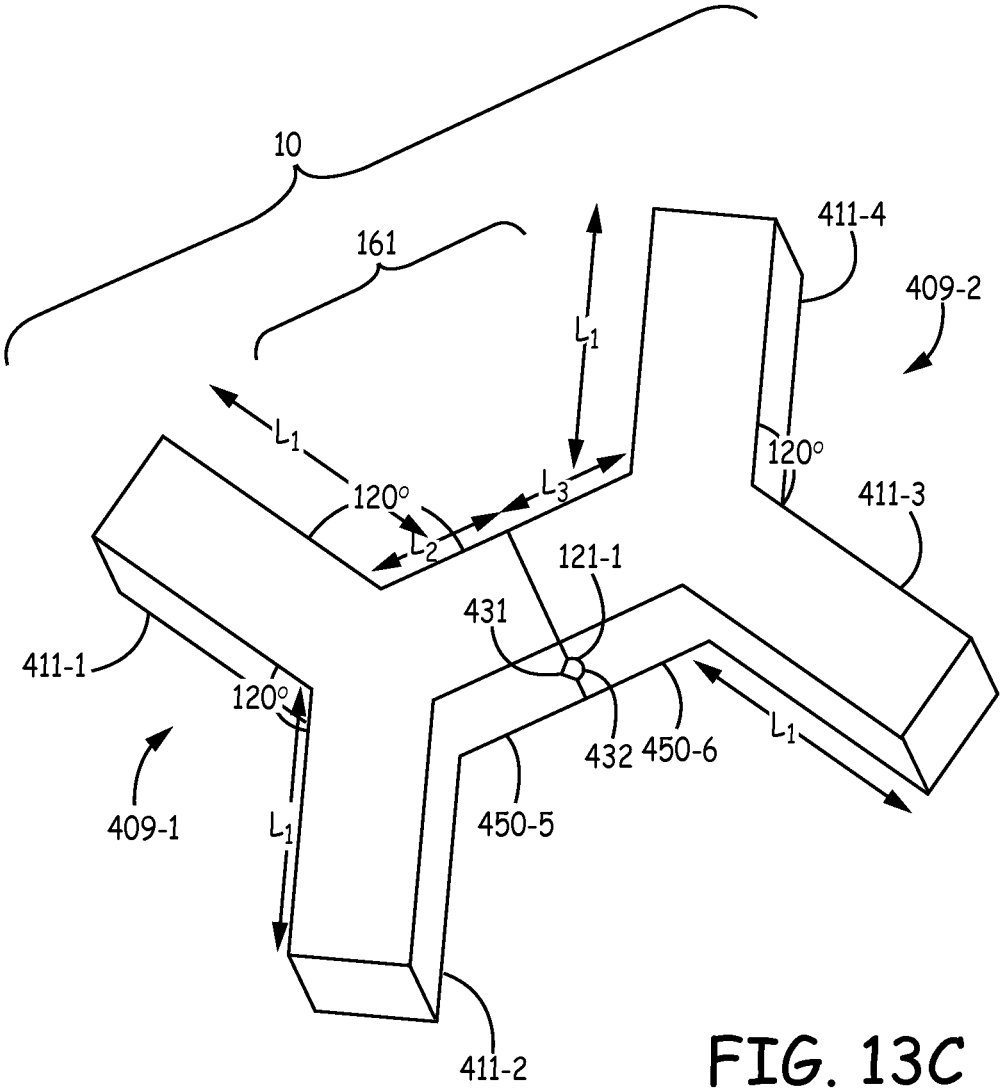

FIG. 12 is a flow diagram illustrating a method 1200 for forming a connected-aperture 121-1 in a connected-branch 161 in a combined-branched-ferrite element 10 in accordance with one embodiment. FIGS. 13A-13C illustrate oblique views of an embodiment of an implementation of the method 1200 of FIG. 12 for forming the combined-branched-ferrite element 10 (FIG. 1). Method 1200 is described with reference to FIGS. 13A-C and is used form the combined-branched-ferrite element 10 of FIG. 1 as shown in FIG. 13C.

At block 1202, at least one indent is formed on at least one of: a first-end surface 433 of the connected-branch-first-resonator section 409-1 and a second-end surface 434 of the connected-branch-second-resonator section 409-2. As shown in FIGS. 13A and 13B, an indent 431 is formed on first-end surface 433 of the connected-branch-first-resonator section 409-1 and an indent 432 is formed on the second-end surface 434 of the connected-branch-second-resonator section 409-2. The indents can have any shape. As shown in FIG. 13A, the indent 433 is shaped as a v-groove that extends across the first-end surface 433. As shown in FIG. 13B, the indent 432 is shaped as a semi-circular groove that extends across the second-end surface 433.

At block 1204, the first-end surface 433 and the second-end surface 434 are bonded together. The indents 432 and 433, regardless of the shape of their surfaces, are arranged on the respective first-end surface 431 and second-end surface 433 to be adjacent to and aligned to each other. In this embodiment, in order for the return-path section 141-1 of the first-branched-ferrite element 409-1 to function as a resonator section 131-2 of the second-branched-ferrite element 409-2, the second length $L_2$ and the third length $L_3$ are equal. Any adhesive squeezed into the aperture during bonding is cleaned out after bonding.

Any of methods 900, 1000, and 1200 will also include opening a first I/O aperture 112-1 through a first I/O branch 411-1 of the first-branched-ferrite element 409-1; opening a second I/O aperture 112-2 through a second I/O branch 411-2 of the first-branched-ferrite element 409-1; opening a third I/O aperture 112-3 through a first I/O branch 411-3 of the second-branched-ferrite element 409-2; and opening a fourth I/O aperture 112-4 through a second I/O branch 411-4 of the second-branched-ferrite element 109-2. The I/O apertures 112(1-4) can be drilled or etched through the respective I/O branches 411(1-4).

Figure 14:
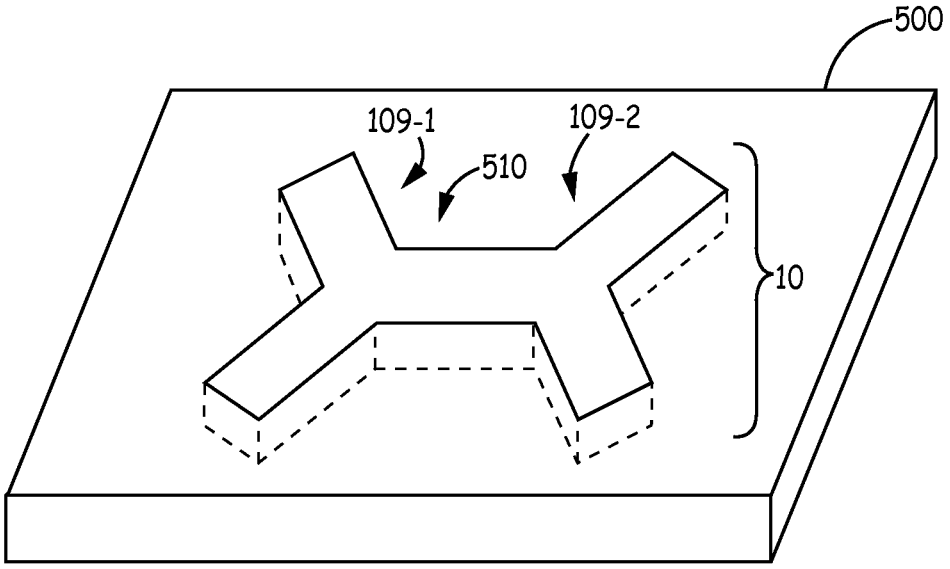
FIG. 14 illustrates an oblique view of a method for forming a combined-branched-ferrite element in accordance with one embodiment.

FIG. 14 illustrates an oblique view of a method for forming a combined-branched-ferrite element in accordance with one embodiment. A piece of material 500 is used to forming a combined-branched-ferrite element in accordance with one embodiment. As described herein the piece of material is a ferrite material 500. However, any other suitable ferrimagnetic material can be used.

An outline 510 of the first-branched-ferrite element 109-1 that includes three branches extending at 120 degrees from each other and the second-branched-ferrite element 109-2 is shown in the piece of material 500. This outline is machined to form the combined-branched-ferrite element 10. Once the machined structure is released from the piece of material 500, a connected-aperture is opened (as described above) through the one of the at least one connected-branch 161 (FIG. 1).

Likewise, once the machined structure is released from the piece of material 500, the I/O apertures 112(1-4) are opened through the respective I/O branches 111(1-4) of the first-branched-ferrite element 109-1 and the second-branched-ferrite element 109-2.

Example Embodiments

Example 1 includes a combined-branched-ferrite element comprising: at least two branched-ferrite elements, the branched-ferrite elements having three branches, wherein at least one of the three branches in the at least two ferrite elements is connected to a branch of another one of the at least two ferrite elements to form at least one connected-branch, wherein unconnected branches are input/output (I/O) branches, wherein the I/O branches include input/output (I/O) apertures in respective I/O branch planes that divide the respective I/O branches into resonator sections and return-path sections, and wherein at least one connected-aperture in the at least one connected-branch that connects two ferrite elements is in a respective connected-branch plane that separates the at least one connected-branch so that: the resonator section of the at least one connected-branch for a first-branched-ferrite element is a return-path section of the at least one connected-branch for a second-branched-ferrite element; and the resonator section of the at least one connected-branch for the second-branched-ferrite element is a return-path section of the at least one connected-branch for the first-branched-ferrite element.

Example 2 includes the combined-branched-ferrite element of Example 1, further comprising: a control wire having a first-end and a second-end, the control wire being wound through the I/O apertures and the at least one connected-aperture, wherein a first current applied to flow from the second-end to the first-end causes electro-magnetic radiation input at a first I/O branch to be output from a second I/O branch, and a second current applied to flow from the first-end to the second-end causes electro-magnetic radiation input at the first I/O branch to be output from a third I/O branch.

Example 3 includes the combined-branched-ferrite element of any of Examples 1-2, wherein the at least two branched-ferrite elements include three branched-ferrite elements.

Example 4 includes the combined-branched-ferrite element of any of Examples 1-3, wherein the at least two branched-ferrite elements include three branched-ferrite elements, and wherein the at least one connected-branch includes a first connected-branch and a second connected branch, the combined-branched-ferrite element further comprising: a control wire having a first-end and a second-end, the control wire being arranged to wind: through a first I/O aperture in a first branch of a first-branched-ferrite element; through a second I/O aperture in a second branch of the first-branched-ferrite element; through a first connected-aperture in the first connected-branch; through a third I/O aperture in a second branch of the second-branched-ferrite element; through a second-connected-aperture in the second connected-branch; through a fourth I/O aperture in a second branch of the third-branched-ferrite element; and through a fifth I/O aperture in a third branch of the third-branched-ferrite element.

Example 5 includes the combined-branched-ferrite element of Example 4, wherein, the first-end is at the first I/O aperture and the second-end is at the fifth I/O aperture, when a first current applied to flow from the first-end to the second-end causes electro-magnetic radiation input at the second branch of the second-branched-ferrite element to be output from the second branch of the first-branched-ferrite element, and when a second current applied to flow from the second-end to the first-end causes the electro-magnetic radiation input at the second branch of the second-branched-ferrite element to be output from the second branch of the third-branched-ferrite element.

Example 6 includes the combined-branched-ferrite element of any of Examples 1-2, wherein the at least two branched-ferrite elements include four branched-ferrite elements, and wherein the at least one connected-branch includes a first connected-branch, a second connected branch, and a third connected branch.

Example 7 includes the combined-branched-ferrite element of Example 6, wherein the first connected-branch connects a third branch of a first-branched-ferrite element to a first branch of a second-branched-ferrite element; the second connected branch connects a third branch of the second-branched-ferrite element to a first branch of a third-branched-ferrite element; and the third connected branch connects a third branch of the third-branched-ferrite element to a first branch of a fourth-branched-ferrite element.

Example 8 includes the combined-branched-ferrite element of Example 7, further comprising: a control wire having a first-end and a second-end, the control wire being arranged to wind: through a first I/O aperture in a first branch of a first-branched-ferrite element; through a second I/O aperture in a second branch of the first-branched-ferrite element; through a first connected-aperture in a first connected-branch; through a third I/O aperture in a second branch of the second-branched-ferrite element; through a second-connected-aperture in a second connected-branch; through a fourth I/O aperture in a second branch of the third-branched-ferrite element; through a third-connected-aperture in a third connected-branch; through a fifth I/O aperture in a second branch of the fourth-branched-ferrite element; and through a sixth I/O aperture in a third branch of the fourth-branched-ferrite element.

Example 9 includes the combined-branched-ferrite element of Example 6, wherein the first connected-branch connects a third branch of the first-branched-ferrite element to a first branch of a second-branched-ferrite element; the second connected branch connects a second branch of the second-branched-ferrite element to a first branch of a third-branched-ferrite element; and the third connected branch connects a third branch of the second-branched-ferrite element to a first branch of a fourth-branched-ferrite element.

Example 10 includes the combined-branched-ferrite element of Example 9, further comprising: a control wire having a first-end and a second-end, the control wire being arranged to wind: through a first I/O aperture in a first branch of the first-branched-ferrite element; through a second I/O aperture in a second branch of the first-branched-ferrite element; through a first connected-aperture in the first connected-branch; through a third-connected-aperture in the third connected-branch; through a second-connected-aperture in the second connected-branch; through a third I/O aperture in a second branch of the third-branched-ferrite element; through a fourth I/O aperture in a third branch of the third-branched-ferrite element; through a fifth I/O aperture in a second branch of the fourth-branched-ferrite element; and through a sixth I/O aperture in a third branch of the fourth-branched-ferrite element.

Example 11 includes a method of fabricating a combined-branched-ferrite element, the method comprising: forming at least one connected-branch, the at least one connected-branch including: a resonator section of a first-branched-ferrite element that functions as a return-path section of a second-branched-ferrite element; a return-path section of the first-branched-ferrite element that functions as a resonator section of the second-branched-ferrite element; and forming at least one connected-aperture extending through a respective at least one connected-branch, the at least one connected-aperture formed in a connected-branch plane that separates the resonator section of the first-branched-ferrite element from the return-path section of the first-branched-ferrite element.

Example 12 includes the method of Example 11, further comprising: forming the first-branched-ferrite element including three branches extending at 120 degrees from each other; and forming the second-branched-ferrite element including three branches extending at 120 degrees from each other, wherein the first-branched-ferrite element and the second-branched-ferrite element are connected by the shared connected-branch.

Example 13 includes the method of Example 12, wherein forming the first-branched-ferrite element including the three branches comprises: forming a first input/output (I/O) branch having a first length; forming a second I/O branch having a first length; forming a connected-branch-first-resonator section having a second length and a first-end surface, and wherein forming the second-branched-ferrite element including the three branches comprises: forming a third I/O branch having the first length; forming a fourth I/O branch having the first length; forming a connected-branch-second-resonator section having a third length and a second-end surface.

Example 14 includes the method of Example 13, wherein the second length equals the third length, and wherein forming the at least one connected-aperture extending through the respective at least one connected-branch comprises: forming at least one indent on at least one of: the first-end surface of the connected-branch-first-resonator section; and the second-end surface of the connected-branch-second-resonator section; and bonding the first-end surface to the second-end surface.

Example 15 includes the method of any of Examples 13-14, wherein forming at least one connected-branch comprises: bonding the first-end surface to the second-end surface; and wherein forming the at least one connected-aperture extending through the respective at least one connected-branch comprises: opening the at least one connected-aperture through the bonded at least one connected-branch.

Example 16 includes the method of any of Examples 11-15, wherein forming the at least one connected-branch comprises: machining a first-branched-ferrite element including three branches extending at 120 degrees from each other in a piece of material; and machining a second-branched-ferrite element including three branches extending at 120 degrees from each other in the piece of material, wherein the first-branched-ferrite element and the second-branched-ferrite element are connected by one of the at least one connected-branch, wherein forming the at least one connected-aperture comprises: opening the at least one connected-aperture through the one of the at least one connected-branch.

Example 17 includes the method of any of Examples 11-16, further comprising: opening a first input/output (I/O) aperture through a first I/O branch of the first-branched-ferrite element; opening a second input/output (I/O) aperture through a second I/O branch of the first-branched-ferrite element; opening a third I/O aperture through a first I/O branch of the second-branched-ferrite element; and opening a fourth I/O aperture through a second I/O branch of the second-branched-ferrite element.

Example 18 includes a multi junction waveguide circulator comprising: a branched waveguide having waveguide arms; a combined-branched-ferrite element including: at least three branched-ferrite elements, the at least three branched-ferrite elements having three branches, wherein at least one of the three branches in the at least three ferrite elements is connected to a branch of another one of the at least three ferrite elements to form at least two connected-branches, wherein unconnected branches are input/output (I/O) branches, wherein the I/O branches include input/output (I/O) apertures in respective I/O branch planes that divide the respective I/O branches into resonator sections and return-path sections, and wherein at least two connected-apertures in respective ones of the at least two connected-branches are in a respective connected-branch plane so that for each connected-branch: the resonator section of the connected-branch for one ferrite element is a return-path section of the connected-branch for another ferrite element; and the resonator section of the connected-branch for the other ferrite element is a return-path section of the connected-branch for the one ferrite element, and wherein the combined-branched-ferrite element is arranged so the I/O branches protrude into the respective waveguide arms.

Example 19 includes the multi junction waveguide circulator of Example 18, wherein the at least two connected-branches include a first connected-branch and a second connected branch, the combined-branched-ferrite element further comprising: a control wire having a first-end and a second-end, the control wire being arranged to wind: through a first I/O aperture in a first I/O branch of a first-branched-ferrite element; through a second I/O aperture in a second branch of the first-branched-ferrite element; through a first connected-aperture in the first connected-branch including a third branch of the first-branched-ferrite element and a first branch of a second-branched-ferrite element; through a third I/O aperture in a second I/O branch of the second-branched-ferrite element; through a second-connected-aperture in the second connected-branch including a third branch of the second-branched-ferrite element and a first branch of a third-branched-ferrite element; through a fourth I/O aperture in a second branch of the third-branched-ferrite element; and through a fifth I/O aperture in a third I/O branch of the third-branched-ferrite element.

Example 20 includes the multi junction waveguide circulator of any of Examples 18-19, further comprising: at least one quarter-wave dielectric transformer attached to at least one respective end of at least one I/O branch.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A combined-branched-ferrite element comprising:

at least two branched-ferrite elements, the branched-ferrite elements having three branches, wherein at least one of the three branches in the at least two ferrite elements is connected to a branch of another one of the at least two ferrite elements to form at least one connected-branch, wherein unconnected branches are input/output (I/O) branches, wherein the I/O branches include input/output (I/O) apertures in respective I/O branch planes that divide the respective I/O branches into resonator sections and return-path sections, and wherein at least one connected-aperture in the at least one connected-branch that connects two ferrite elements is in a respective connected-branch plane that separates the at least one connected-branch so that:

the resonator section of the at least one connected-branch for a first-branched-ferrite element is a return-path section of the at least one connected-branch for a second-branched-ferrite element; and the resonator section of the at least one connected-branch for the second-branched-ferrite element is a return-path section of the at least one connected-branch for the first-branched-ferrite element.

2. The combined-branched-ferrite element of claim 1, further comprising:

a control wire having a first-end and a second-end, the control wire being wound through the I/O apertures and the at least one connected-aperture, wherein a first current applied to flow from the second-end to the first-end causes electro-magnetic radiation input at a first I/O branch to be output from a second I/O branch, and a second current applied to flow from the first-end to the second-end causes electro-magnetic radiation input at the first I/O branch to be output from a third I/O branch.

3. The combined-branched-ferrite element of claim 1, wherein the at least two branched-ferrite elements include three branched-ferrite elements.

4. The combined-branched-ferrite element of claim 1, wherein the at least two branched-ferrite elements include three branched-ferrite elements, and wherein the at least one connected-branch includes a first connected-branch and a second connected branch, the combined-branched-ferrite element further comprising:

a control wire having a first-end and a second-end, the control wire being arranged to wind:

through a first I/O aperture in a first branch of a first-branched-ferrite element;

through a second I/O aperture in a second branch of the first-branched-ferrite element;

through a first connected-aperture in the first connected-branch;

through a third I/O aperture in a second branch of the second-branched-ferrite element;

through a second-connected-aperture in the second connected-branch;

through a fourth I/O aperture in a second branch of the third-branched-ferrite element; and through a fifth I/O aperture in a third branch of the third-branched-ferrite element.

5. The combined-branched-ferrite element of claim 4, wherein, the first-end is at the first I/O aperture and the second-end is at the fifth I/O aperture, when a first current applied to flow from the first-end to the second-end causes electro-magnetic radiation input at the second branch of the second-branched-ferrite element to be output from the second branch of the first-branched-ferrite element, and when a second current applied to flow from the second-end to the first-end causes the electro-magnetic radiation input at the second branch of the second-branched-ferrite element to be output from the second branch of the third-branched-ferrite element.

6. The combined-branched-ferrite element of claim 1, wherein the at least two branched-ferrite elements include four branched-ferrite elements, and wherein the at least one connected-branch includes a first connected-branch, a second connected branch, and a third connected branch.

7. The combined-branched-ferrite element of claim 6, wherein the first connected-branch connects a third branch of a first-branched-ferrite element to a first branch of a second-branched-ferrite element;

the second connected branch connects a third branch of the second-branched-ferrite element to a first branch of a third-branched-ferrite element; and the third connected branch connects a third branch of the third-branched-ferrite element to a first branch of a fourth-branched-ferrite element.

8. The combined-branched-ferrite element of claim 7, further comprising:

a control wire having a first-end and a second-end, the control wire being arranged to wind:

through a first I/O aperture in a first branch of a first-branched-ferrite element;

through a second I/O aperture in a second branch of the first-branched-ferrite element;

through a first connected-aperture in a first connected-branch;

through a third I/O aperture in a second branch of the second-branched-ferrite element;

through a second-connected-aperture in a second connected-branch;

through a fourth I/O aperture in a second branch of the third-branched-ferrite element;

through a third-connected-aperture in a third connected-branch;

through a fifth I/O aperture in a second branch of the fourth-branched-ferrite element; and through a sixth I/O aperture in a third branch of the fourth-branched-ferrite element.

9. The combined-branched-ferrite element of claim 6, wherein the first connected-branch connects a third branch of the first-branched-ferrite element to a first branch of a second-branched-ferrite element;

the second connected branch connects a second branch of the second-branched-ferrite element to a first branch of a third-branched-ferrite element; and the third connected branch connects a third branch of the second-branched-ferrite element to a first branch of a fourth-branched-ferrite element.

10. The combined-branched-ferrite element of claim 9, further comprising:

a control wire having a first-end and a second-end, the control wire being arranged to wind:

through a first I/O aperture in a first branch of the first-branched-ferrite element;

through a second I/O aperture in a second branch of the first-branched-ferrite element;

through a first connected-aperture in the first connected-branch;

through a third-connected-aperture in the third connected-branch;

through a second-connected-aperture in the second connected-branch;

through a third I/O aperture in a second branch of the third-branched-ferrite element;

through a fourth I/O aperture in a third branch of the third-branched-ferrite element;

through a fifth I/O aperture in a second branch of the fourth-branched-ferrite element; and through a sixth I/O aperture in a third branch of the fourth-branched-ferrite element.

11. A multi junction waveguide circulator comprising:

a branched waveguide having waveguide arms;

a combined-branched-ferrite element including:

at least three branched-ferrite elements, the at least three branched-ferrite elements having three branches, wherein at least one of the three branches in the at least three ferrite elements is connected to a branch of another one of the at least three ferrite elements to form at least two connected-branches, wherein unconnected branches are input/output (I/O) branches, wherein the I/O branches include input/output (I/O) apertures in respective I/O branch planes that divide the respective I/O branches into resonator sections and return-path sections, and wherein at least two connected-apertures in respective ones of the at least two connected-branches are in a respective connected-branch plane so that for each connected-branch:

the resonator section of the connected-branch for one ferrite element is a return-path section of the connected-branch for another ferrite element; and the resonator section of the connected-branch for the other ferrite element is a return-path section of the connected-branch for the one ferrite element, and wherein the combined-branched-ferrite element is arranged so the I/O branches protrude into the respective waveguide arms.

12. The multi junction waveguide circulator of claim 11, wherein the at least two connected-branches include a first connected-branch and a second connected branch, the combined-branched-ferrite element further comprising:

a control wire having a first-end and a second-end, the control wire being arranged to wind:

through a first I/O aperture in a first I/O branch of a first-branched-ferrite element;

through a second I/O aperture in a second branch of the first-branched-ferrite element;

through a first connected-aperture in the first connected-branch including a third branch of the first-branched-ferrite element and a first branch of a second-branched-ferrite element;

through a third I/O aperture in a second branch of the second-branched-ferrite element;

through a second-connected-aperture in the second connected-branch including a third branch of the second-branched-ferrite element and a first branch of a third-branched-ferrite element;

through a fourth I/O aperture in a second I/O branch of the third-branched-ferrite element; and through a fifth I/O aperture in a third I/O branch of the third-branched-ferrite element.

13. The multi junction waveguide circulator of claim 11, further comprising:

at least one quarter-wave dielectric transformer attached to at least one respective end of at least one I/O branch.

14. A method of fabricating a combined-branched-ferrite element, the method comprising:

forming at least one connected-branch, the at least one connected-branch including:

a resonator section of a first-branched-ferrite element that functions as a return-path section of a second-branched-ferrite element;

a return-path section of the first-branched-ferrite element that functions as a resonator section of the second-branched-ferrite element; and forming at least one connected-aperture extending through a respective at least one connected-branch, the at least one connected-aperture formed in a connected-branch plane that separates the resonator section of the first-branched-ferrite element from the return-path section of the first-branched-ferrite element.

15. The method of claim 14, wherein forming the at least one connected-branch comprises:

machining a first-branched-ferrite element including three branches extending at 120 degrees from each other in a piece of material; and machining a second-branched-ferrite element including three branches extending at 120 degrees from each other in the piece of material, wherein the first-branched-ferrite element and the second-branched-ferrite element are connected by one of the at least one connected-branch, wherein forming the at least one connected-aperture comprises:

opening the at least one connected-aperture through the one of the at least one connected-branch.

16. The method of claim 15, further comprising:

opening a first input/output (I/O) aperture through a first I/O branch of the first-branched-ferrite element;

opening a second input/output (I/O) aperture through a second I/O branch of the first-branched-ferrite element;

opening a third I/O aperture through a first I/O branch of the second-branched-ferrite element; and opening a fourth I/O aperture through a second I/O branch of the second-branched-ferrite element.

17. The method of claim 14, further comprising:

forming the first-branched-ferrite element including three branches extending at 120 degrees from each other; and forming the second-branched-ferrite element including three branches extending at 120 degrees from each other, wherein the first-branched-ferrite element and the second-branched-ferrite element are connected by the shared connected-branch.

18. The method of claim 17, wherein forming the first-branched-ferrite element including the three branches comprises:

forming a first input/output (I/O) branch having a first length;

forming a second I/O branch having a first length;

forming a connected-branch-first-resonator section having a second length and a first-end surface, and wherein forming the second-branched-ferrite element including the three branches comprises:

forming a third I/O branch having the first length;

forming a fourth I/O branch having the first length;

forming a connected-branch-second-resonator section having a third length and a second-end surface.

19. The method of claim 18, wherein the second length equals the third length, and wherein forming the at least one connected-aperture extending through the respective at least one connected-branch comprises:

forming at least one indent on at least one of: the first-end surface of the connected-branch-first-resonator section; and the second-end surface of the connected-branch-second-resonator section; and bonding the first-end surface to the second-end surface.

20. The method of claim 18, wherein forming at least one connected-branch comprises:

bonding the first-end surface to the second-end surface; and wherein forming the at least one connected-aperture extending through the respective at least one connected-branch comprises:

opening the at least one connected-aperture through the bonded at least one connected-branch.

* * * * *